US007780268B2

(12) United States Patent
Sugahara

(10) Patent No.: US 7,780,268 B2
(45) Date of Patent: Aug. 24, 2010

(54) LIQUID TRANSPORT APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 491 days.

(21) Appl. No.: 11/862,939

(22) Filed: Sep. 27, 2007

(65) Prior Publication Data

US 2008/0186363 A1 Aug. 7, 2008

(30) Foreign Application Priority Data

Sep. 28, 2006 (JP) ..... 2006-264326

(51) Int. Cl.
*B41J 2/04* (2006.01)

(52) U.S. Cl. ..... 347/54; 347/55

(58) Field of Classification Search ..... 347/54, 347/55, 68, 70–72, 84–87, 199
See application file for complete search history.

(56) References Cited

U.S. PATENT DOCUMENTS 4,162,502 A * 7/1979 Cielo et al. ..... 347/55
2005/0219330 A1 10/2005 Sugahara

FOREIGN PATENT DOCUMENTS

JP 2005-199231 A 7/2005
JP 2005-288875 A 10/2005

* cited by examiner

*Primary Examiner*—Juanita D Stephens
(74) *Attorney, Agent, or Firm*—Banner & Witcoff, Ltd.

(57) ABSTRACT

A liquid transport apparatus includes liquid transport channels disposed on an insulating surface of a substrate, individual electrodes disposed in regions corresponding to respective ones of the liquid transport channels, and wiring portions extending along the insulating surface of the substrate. The apparatus further includes a first insulating layer disposed so as to cover the electrodes and in which the wetting angle with respect to a conductive liquid changes according to an electrical potential difference between the conductive liquid and the electrodes, a second insulating layer which is disposed so as to cover the wiring portions disposed in contact with the first insulating layer, and a potential applying unit which applies an electric potential to the electrodes.

18 Claims, 19 Drawing Sheets

Frontward

LIQUID TRANSPORT APPARATUS

CROSS REFERENCE TO RELATED APPLICATION

The present application claims priority from Japanese Patent Application No. 2006-264326, filed on Sep. 28, 2006, the disclosure of which is incorporated herein by reference in its entirety.

BACKGROUND

Aspects of the present invention relate to a liquid transport apparatus which transports a liquid.

In a printer which records an image or the like by discharging ink onto a recording medium, such as a recording sheet, an ink-jet recording head which ejects ink from nozzles toward the recording medium is generally employed. However, in such an ink-jet recording head, the structure of a flow passage for generating ink ejection pressure and the structure of an actuator are special and complicated. As a result, there is a limitation in reducing the size of the recording head by arranging nozzles in a high density relationship.

Accordingly, a recording head of a new type has been proposed using an electrowetting phenomenon in which, when an electrode potential is changed in a state where the surface of an electrode is covered with an insulating layer, the wetting angle of the liquid (liquid repellency) at the surface of the insulating layer changes. This recording head includes individual flow passages each composed of a recess. An individual electrode is provided on each individual flow passage (on the bottom face of the recess), and the surface of the individual electrode is covered with an insulating layer. Ink disposed in the head is in contact with a common electrode which is maintained at ground potential, and the electric potential of the ink is always set at ground potential. A pump, which pressurizes the ink toward a discharge port located at the end of the individual flow passage, is also provided on the upstream side of the individual flow passage.

When the electric potential of the individual electrode is set at ground potential and there is no electrical potential difference between the ink and the individual electrode, the wetting angle of the ink at the surface of the insulating layer interposed between the ink and the individual electrode is large compared with a region of the bottom face of the recess not provided with the insulating layer. Consequently, the ink is not allowed to pass over the surface of the insulating layer and flow toward the discharge port, and the ink is not discharged from the discharge port. On the other hand, when the electrical potential of the individual electrode is switched to a predetermined electrical potential that is different from the ground potential, an electrical potential difference occurs between the ink and the individual electrode. As a result, the wetting angle of the ink at the surface of the insulating layer interposed between the ink and the individual electrode is decreased causing the electrowetting phenomenon. Consequently, the ink pressurized by the pump is allowed to wet the surface of the insulating layer and move toward the discharge port, and the ink is discharged from the discharge port.

SUMMARY

Aspects of the present invention provide a liquid transport apparatus. A liquid transport apparatus may include a substrate having an insulating surface, liquid transport channels which are disposed on the insulating surface of the substrate and in each of which a conductive liquid is transported, and electrodes disposed on the insulating surface of the substrate in regions corresponding to respective ones of the liquid transport channels. The apparatus may further include wiring portions each having a terminal at an end thereof and each being coupled to the surface of a corresponding one of the electrodes and extending along the insulating surface of the substrate, a first insulating layer which is disposed so as to cover the electrodes on the insulating surface of the substrate and in which a wetting angle with respect to the conductive liquid changes according to an electrical potential difference between the conductive liquid and the electrodes, and a second insulating layer which is disposed so as to cover the wiring portions on the insulating surface of the substrate and which is disposed in contact with the first insulating layer. Also, the apparatus may include a potential applying unit which applies an electric potential to each of the electrodes through each terminal provided on the wiring portions. When the electrical potential difference between the conductive liquid and the electrodes is less than a predetermined electrical potential difference, the wetting angle of the first insulating layer with respect to the conductive liquid is larger than the wetting angle of the second insulating layer with respect to the conductive liquid.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
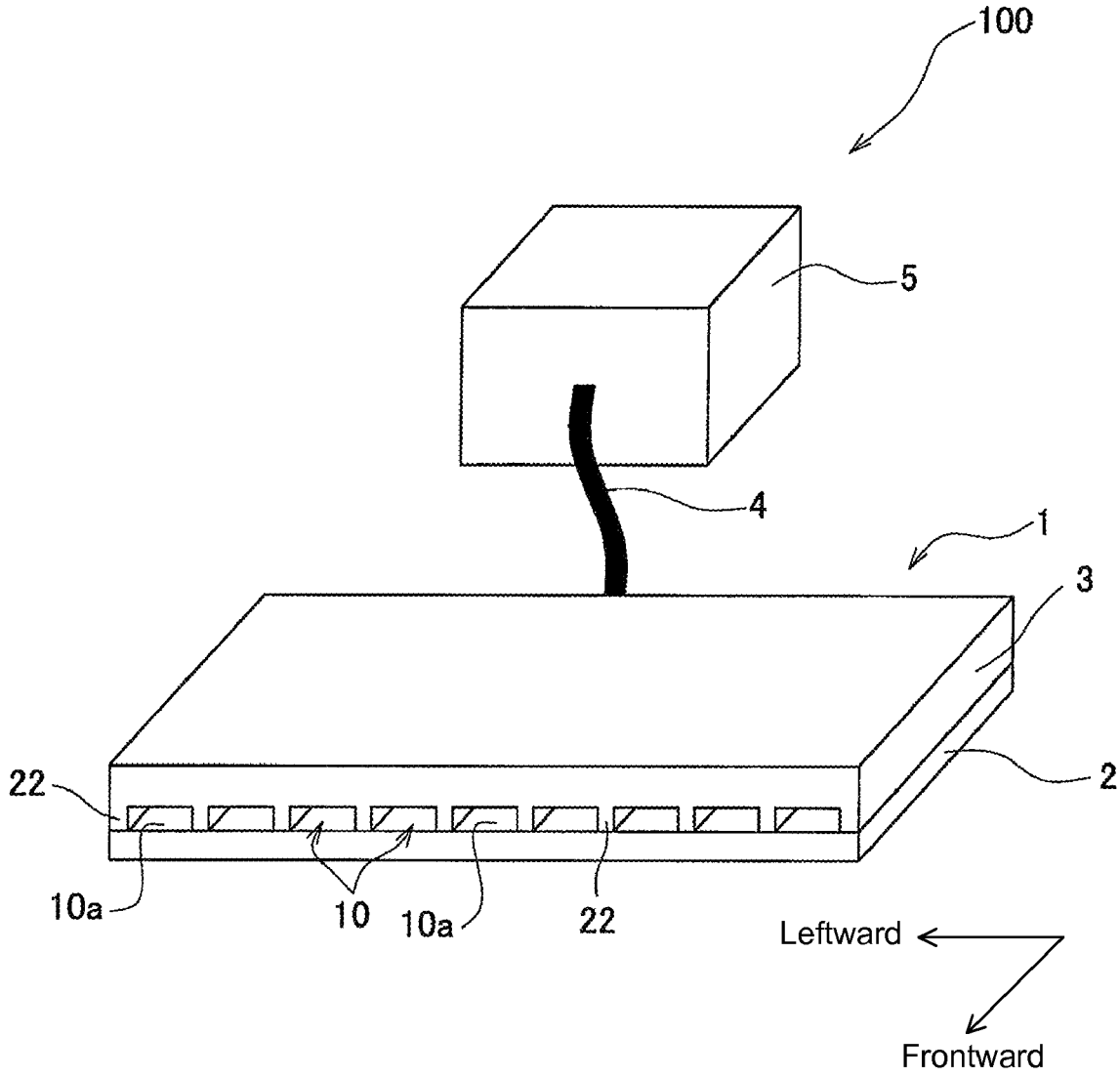
FIG. 1 is an illustration schematically showing a structure of a printer according to a first illustrative embodiment of the present invention.

A first illustrative embodiment of the present invention will be described below with reference to the drawings. The first illustrative embodiment relates to an example in which the present invention is applied to an image forming device, such as a printer that performs printing by transporting a conductive liquid, which in this example is an ink to a recording sheet. FIG. 1 is an illustration schematically showing a structure of a printer according to the first illustrative embodiment. As shown in FIG. 1, a printer 100 includes a liquid transport apparatus, for example an ink transport head 1 which includes liquid transport channels such as individual ink flow passages 10 each having a discharge port 10*a*, and an ink tank 5 which is connected to the ink transport head 1 by a tube 4. The printer 100 records a desired image by discharging ink from the discharge ports 10*a* of the ink transport head 1 toward a recording sheet P (refer to FIGS. 5A and 5B). The ink used in the printer 100 is a conductive ink, such as a water-based dye ink containing water as a main component, and a dye and a solvent added thereto, or a water-based pigment ink containing water as a main component, and a pigment and a solvent added thereto. Hereinafter, front-back and left-right directions are respectively defined as shown in FIG. 1.

Figure 2:
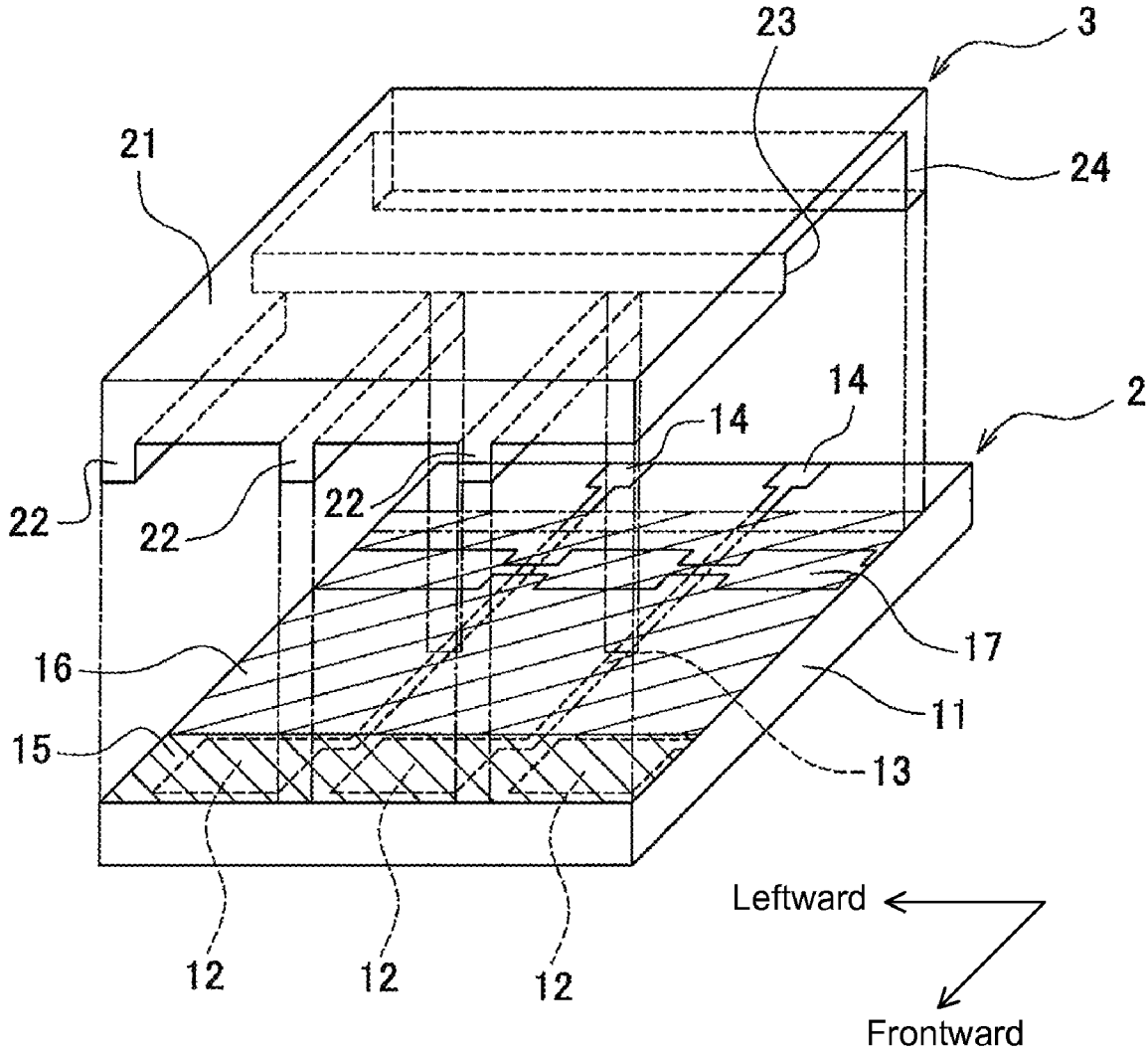
FIG. 2 is an exploded perspective view showing a part of an ink transport head shown in FIG. 1.
Figure 3:
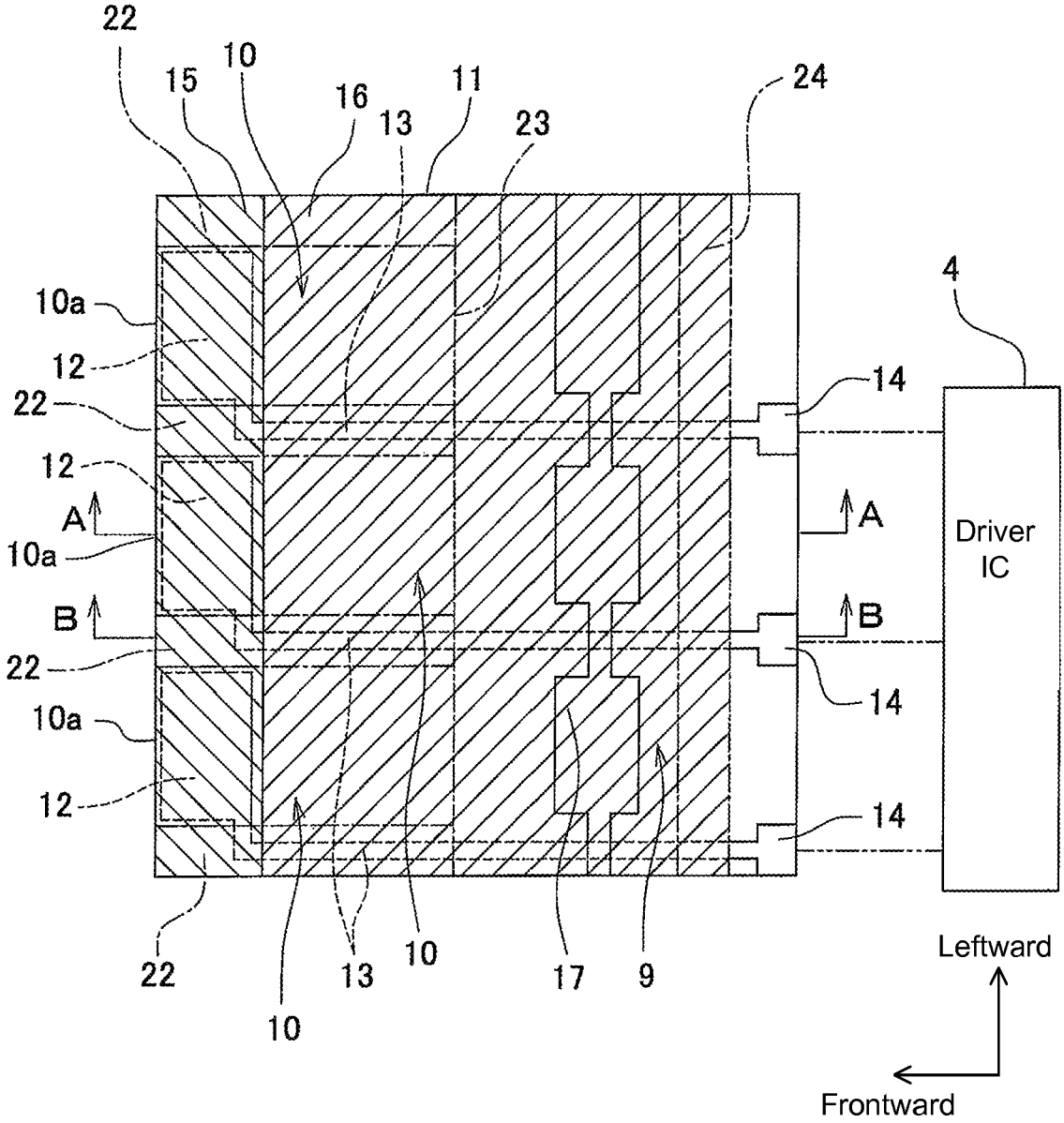
FIG. 3 is a plan view showing the ink transport head shown in FIG. 2.
Figure 4A:
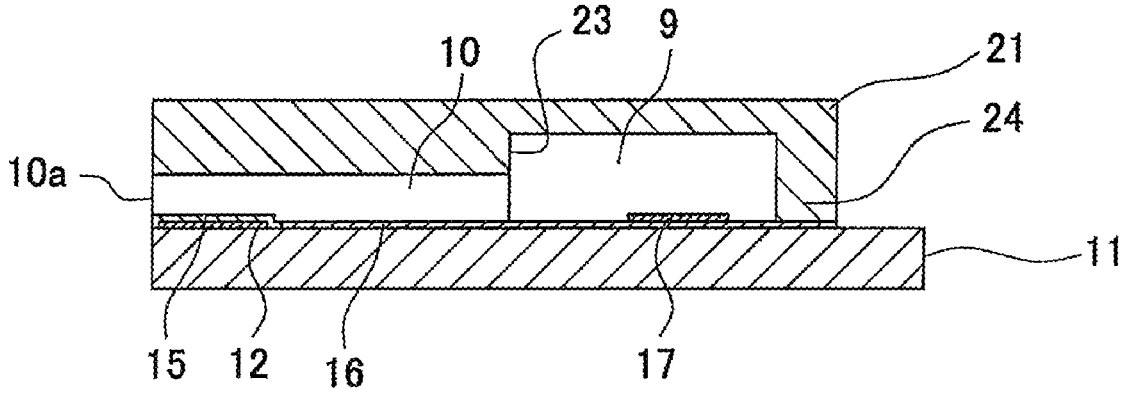
FIG. 4A is a sectional view taken along the line A-A of FIG. 3.
Figure 4B:
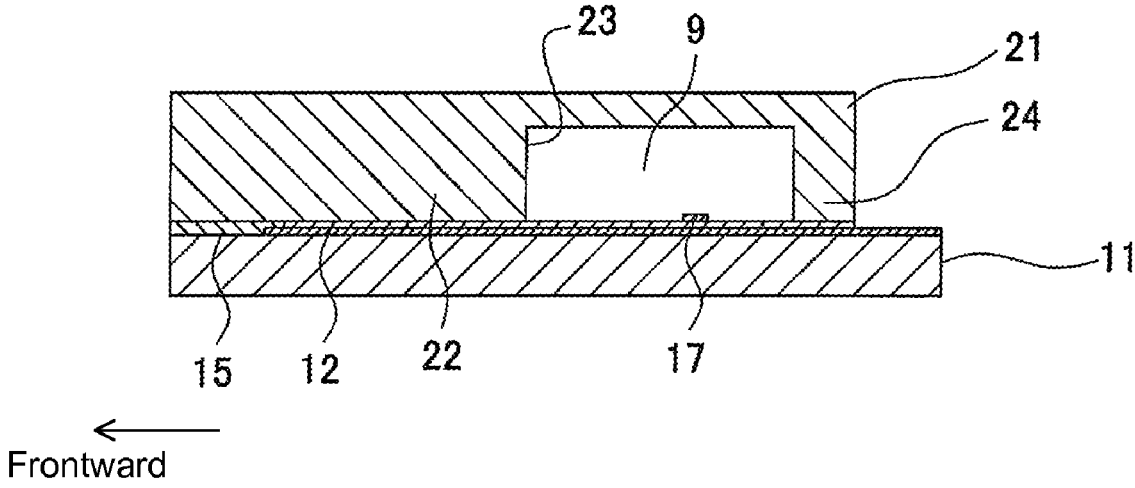
FIG. 4B is a sectional view taken along the line B-B of FIG. 3.

FIG. 2 is an enlarged, exploded perspective view showing a part of the ink transport head 1 shown in FIG. 1. FIG. 3 is a plan view of FIG. 2. FIG. 4A is a sectional view taken along the line A-A of FIG. 3, and FIG. 4B is a sectional view taken along the line B-B of FIG. 3. As shown in FIGS. 1 to 4B, the ink transport head 1 may include a lower member 2 constituting a substantially lower half portion and an upper member 3 constituting a substantially upper half portion, the lower member 2 and the upper member 3 being bonded to each other. In the ink transport head 1, a common ink flow passage 9 extends in the left-right direction, and individual ink flow passages 10 branched from the common ink flow passage 9 extend to the front side, the individual ink flow passages 10 being spaced a predetermined distance from each other in the left-right direction.

The common ink flow passage 9 is disposed on the upstream side of (i.e., at the back of) the individual ink flow passages 10, and communicates with all of the individual ink flow passages 10. The common ink flow passage 9 is connected to the ink tank 5 by the tube 4. The ink is supplied from the ink tank 5 to the common ink flow passage 9, and is further supplied from the common ink flow passage 9 to the individual ink flow passages 10. The ink tank 5 is disposed at a position slightly higher than the common ink flow passage 9, and under the influence of the back pressure from the ink tank 5, the ink flows in the common ink flow passage 9 toward the discharge ports 10*a*. According to such an arrangement, since the ink transport head 1 includes the individual ink flow passages 10 and the common ink flow passage 9 which communicates with the individual ink flow passages 10, it is possible to supply the ink easily to the individual ink flow passages 10 by supplying the ink from the ink tank 5 to the common ink flow passage 9.

The lower member 2 and the upper member 3 constituting the ink transport head 1 will now be described.

The lower member 2 includes individual electrodes 12, wiring portions 13, terminals 14, insulating layers 15 and 16, and a common electrode 17 disposed on an upper surface of a substrate 11. The substrate 11 is a plate-like body having a substantially rectangular planar shape composed of an insulating material, such as polyimide, polyamide, or polyacetal, or a plate-like body at least one surface of which has an insulating property, for example, a plate-like body composed of silicon having a silicon oxide layer on a surface thereof. The individual electrodes 12 each have a substantially rectangular planar shape and are disposed a predetermined distance apart from each other in the left-right direction of the substrate 11 on the front end of the substrate 11 in the regions of the individual ink flow passages 10 so as to correspond to the individual ink flow passages 10.

Each of the wiring portions 13 extends rightward from the right back corner of the corresponding individual electrode 12 to a region between the corresponding individual electrode and an immediately adjacent individual electrode 12. Each wiring portion 13 is bent substantially at a right angle toward the back of the substrate 11, passes through a region between the adjacent individual ink flow passages 10 on the upper surface of the substrate 11, and a region corresponding to a bottom face or surface of the common ink flow passage 9, and extends to a terminal 14 disposed on a back end of the substrate 11. That is, the wiring portions 13 extend from the individual electrodes 12 toward the upstream side of the transport direction of the ink in the individual ink flow passages 10. Since the wiring portions 13 are disposed between the individual ink flow passages 10, the ink in the individual ink flow passages 10 is prevented from being brought into contact with the wiring portions 13.

The terminals 14 are disposed on the back end of the substrate 11 in regions overlapping the regions between the individual ink flow passages 10 with respect to the left-right direction, and each have a substantially rectangular planar shape. The terminals 14 are connected to a driver IC 4 function as a potential applying unit and a ground potential or a drive potential V1 is selectively applied by the driver IC 4 to each of the individual electrodes 12 through the terminals 14 and the wiring portions 13. According to such an arrangement, since the wiring portions 13 extend toward the upstream side in the transport direction of the ink in the individual ink flow passages 10 and the terminals 14 are disposed on the back end of the substrate 11, even when many individual electrodes 12 are highly integrated, it is possible to perform connection to the driver IC 4 by the terminals 14 disposed on the back end of the substrate 11. Note that the driver IC 4 may be disposed on the back end of the upper surface of the substrate 11 and not directly connected to the terminals 14, and may be connected to the terminals 14 through a flexible printed circuit board (FPC) or the like (not shown).

The individual electrodes 12, the wiring portions 13, and the terminals 14 are each composed of a conductive material, such as a metal, and can be formed by screen-printing, sputtering, vapor deposition, or the like. Since all of the individual electrodes 12, the wiring portions 13, and the terminals 14 are disposed on the upper surface of the substrate 11, these components can be connected to each other on the upper surface of the substrate 11. Consequently, it is not necessary to form through-holes in the substrate 11 in order to connect these components to each other. Thus, the structure of the ink transport head 1 can be simplified, and the manufacturing cost can be reduced. Furthermore, since all of the individual electrodes 12, the wiring portions 13, and the terminals 14 are disposed on the upper surface of the substrate 11, these components can be formed at one time by the method described above.

According to the arrangement described above, on the upper surface of the substrate 11, the individual electrodes 12 are disposed on the front end along the left-right direction, the terminals 14 are disposed on the back end along the left-right direction, and the wiring portions 13 which connect the individual electrodes 12 to the terminals 14 are disposed, parallel to the individual ink flow passages 10, between the adjacent individual ink flow passages 10. Therefore, the arrangement of the individual electrodes 12, the wiring portions 13, and the 14 is simple.

The insulating layer 15 is composed of an insulating material, such as a fluorocarbon resin, and extends in the left-right direction at the front end on the upper surface of the substrate 11 so as to cover the individual electrodes 12. The insulating layer 15 may be composed of the same insulating material as the substrate 11. The insulating layer 15 may be formed by a method in which an insulating material is applied by spin coating to the entire region of the upper surface of the substrate 11, and then unnecessary portions are removed by laser. Alternatively, a method may be employed in which a mask is applied to the upper surface of the substrate 11 except for a portion on which the insulating layer 15 is to be formed, and the insulating layer 15 is formed by CVD, or a method may be employed in which an insulating material is coated on the upper surface of the substrate 11 to form the insulating layer 15.

The insulating layer 16 is composed of an insulating material, such as alumina, that is different from the insulating layer 15. The insulating layer 16 extends from a region in contact with the back or edge of the insulating layer 15 (with respect to the transport direction of the ink) with respect to the front-back direction (i.e., a region adjacent to the region where the insulating layer 15 is arranged) to a portion slightly in front of the terminals 14 so as to cover the individual ink flow passages 10. Thus, the insulating layer 16 covers the regions where the wiring portions 13 are disposed and most of the regions where the individual ink flow passages 10 which are not provided with the insulating layer 15 are disposed. The insulating layer 16 may be formed by an aerosol deposition method (AD method) in which deposition is performed by spraying fine particles of an insulating material onto the substrate 11. In addition, the insulating layer 16 can also be formed by CVD, sputtering, or the like. In such a case, since the insulating layer 16 is formed in the continuous regions on the upper surface of the substrate 11, the insulating layer 16 can be formed at one time by the method described above.

The common electrode 17 extends in the left-right direction in a region corresponding to the bottom face or surface of the common ink flow passage 9, slightly at the back of a central portion with respect to front-back direction of the upper surface of the substrate 11 on which the insulating layer 15 is disposed. In sections where the common electrode 17 overlaps the insulating layer 16 covering wiring portions 13 in a plan view (i.e., sections where the common electrode 17 intersects with the wiring portions 13 with the insulating layer 16 therebetween), the length of the common electrode 17 with respect to the front-back direction (i.e., the length or width in the extending direction of the wiring portion 13) is less than the length of the common electrode 17 in the direction in sections where the wiring portions 13 do not intersect with the common electrode 17. In the other sections, the common electrode 17 extends with a larger, predetermined width. According to such an arrangement, the area of the sections where the common electrode 17 intersects with the wiring portions 13 with the insulating layer 16 therebetween is decreased, and thus it is possible to reduce the capacitance of a section in which the insulating layer 16 is interposed between each wiring portion 13 and the common electrode 17. Furthermore, the common electrode 17 is connected to the driver IC 4 at a position not shown, and the common electrode 17 is maintained at the ground potential by the driver IC 4. Thus, the ink in the common ink flow passage 9 and the ink in the individual ink flow passages 10 which communicate with the common ink flow passage 9 are maintained at the ground potential. The common electrode 17 is composed of the same conductive material as each of the individual electrodes 12, the wiring portions 13, and the terminals 14 and similarly can be formed by screen-printing, sputtering, vapor deposition, or the like.

The upper member 3 includes partition walls 22, a recess 23, and a partition wall 24 disposed on a substrate 21. The substrate 21 is a plate-like body which is composed of an insulating material, such as silicon, polyimide, polyamide, or polyacetal, and which has a substantially rectangular planar shape with a length with respect to the front-back direction being slightly smaller than that of the substrate 11. The substrate 21 is not necessarily composed of the same material as the substrate 11, and may be composed of an insulating material.

The partition walls 22 protrude downward from regions of the lower surface of the substrate 21 overlapping regions between adjacent individual ink flow passages 10 in a plan view, and extend from the front end of the substrate 21 in the front-back direction to the a central portion with respect to the front-back direction. When the lower member 2 and the upper member 3 are bonded to each other, spaces surrounded by the upper surface of the substrate 11, the lower surface of the substrate 21, and the partition walls 22 serve as the individual ink flow passages 10. Each of the two adjacent individual ink flow passages 10 is separated by a partition wall 22. In such a case, as described above, since the partition walls 22 cover portions of the insulating layer 16 covering the wiring portions 13, even if the insulating layer 16 is partially damaged, the ink in the individual ink flow passages 10 can be prevented from being brought into contact with the wiring portions 13 by the partition walls 22.

The recess 23 is disposed on the lower surface of the substrate 21 in a region between a central portion with respect to the front-back direction and the back end of the substrate 21, in the left-right direction with a length substantially equal to the overall length of the substrate 21. When the lower member 2 and the upper member 3 are bonded to each other, a space surrounded by the upper surface of the substrate 11 and the recess 23 serves as the common ink flow passage 9. The partition wall 24 protrudes downward from the back end of the lower surface of the substrate 21 to a position at the same level as the lower end of each partition wall 22 and extends with a length substantially equal to the overall length of the substrate 21 in the left-right direction.

The operations of the ink transport head 1 will now be described with reference to FIGS. 5A and 5B, which are sectional views each showing an operation of the ink transport head 1.

In the ink transport head 1, when an electrical potential difference occurs between the individual electrode 12 and the ink in the individual ink flow passage 10, the wetting angle of the ink at the insulating layer 15 in a region facing the corresponding individual electrode 12 changes according to the electrical potential difference (electrowetting phenomenon). More particularly, the relationship $$\cos\theta V=\cos\theta 0+\tfrac{1}{2}\times[(\in\times\in 0)/(\gamma\times t)]\times V2$$

is satisfied, where θV is the wetting angle of the insulating layer 15 when the electrical potential difference V occurs between the individual electrode 12 and the ink in the individual ink flow passage 10, θ0 is the wetting angle of the insulating layer 15 when no electrical potential difference occurs between the individual electrode 12 and the ink in the individual ink flow passage 10, ∈ is the relative dielectric constant of the insulating layer 15, ∈0 is the dielectric constant of a vacuum, γ is the surface tension at the gas-liquid interface, and t is the thickness of the insulating layer 15. Consequently, as the electrical potential difference V between the individual electrode 12 and the ink in the individual ink flow passage 10 increases, cos θV increases. That is, θV decreases, and the liquid repellency at the surface of the insulating layer 15 decreases.

Figure 5A:
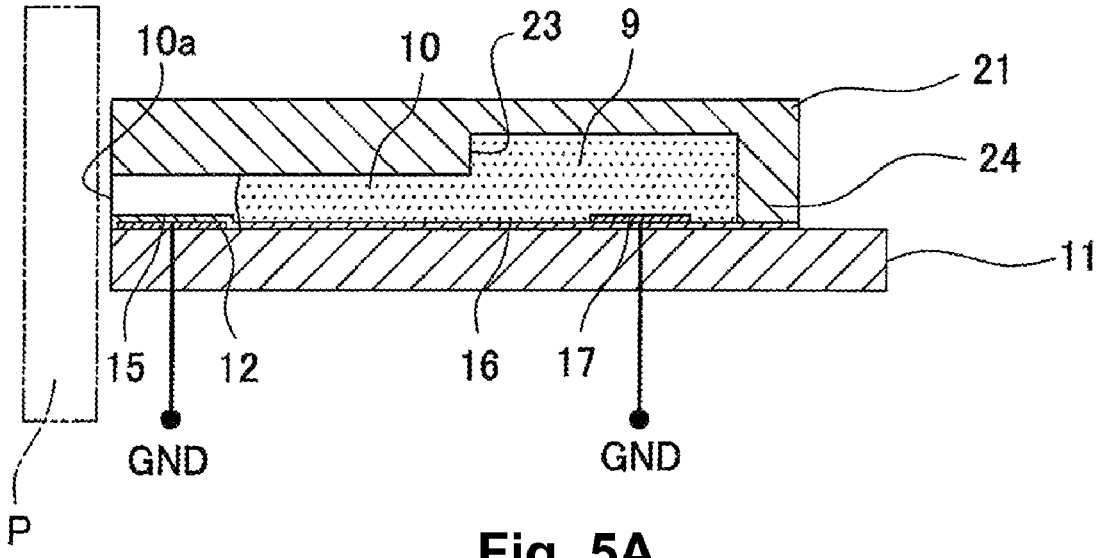
FIGS. 5A and 5B are sectional views each showing an operation of the ink transport head shown in FIG. 2.

In the ink transport head 1, when the ink is not discharged from the discharge port 10*a*, as shown in FIG. 5A, a ground potential is applied to the individual electrode 12, and there is no electrical potential difference between the individual electrode 12 and the ink in the individual ink flow passage 10, the ink being maintained at the ground potential. At this time, the wetting angle of the ink on the surface of the insulating layer 15 (e.g., 110°) is larger than the wetting angle of the ink on the surface of the insulating layer 16 (e.g., 60°) and is larger than a wetting angle (critical wetting angle) of the insulating layer 15 at which the ink can move from a portion of the individual ink flow passage 10 facing the insulating layer 16 to a portion of the individual ink flow passage 10 facing the insulating layer 15. Consequently, the meniscus of the ink in the individual ink flow passage 10 stops at an edge of the insulating layer 15 proximal to the insulating layer 16, and the ink does not flow into a portion of the individual ink flow passage 10 facing the insulating layer 15. Thus, the ink is not discharged from the discharge port 10*a*. Note that the critical wetting angle is determined according to the wetting angle of the ink at the surface of the insulating layer 15, the wetting angle of the ink at the surface of the insulating layer 16, the surface tension of the ink, the structures of the common ink flow passage 9 and the individual ink flow passage 10, the magnitude of the back pressure of the ink flowing from the ink tank 5 into the common ink flow passage 9, and the like.

Figure 5B:
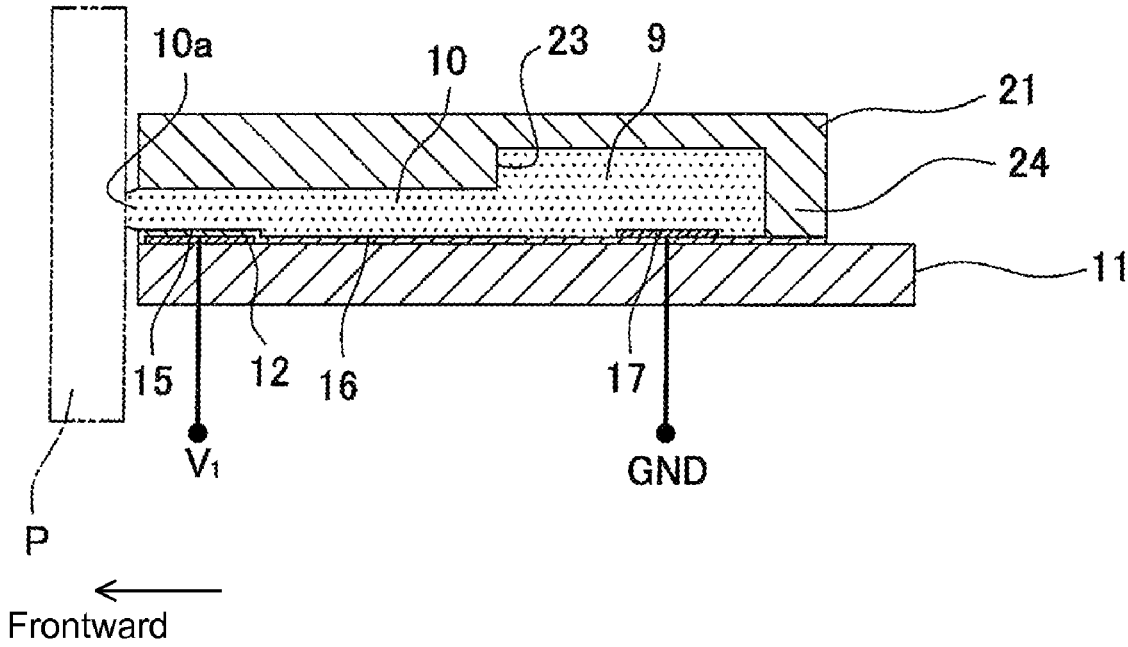

On the other hand, when the ink is discharged from the discharge port 10*a*, as shown in FIG. 5B, a drive potential V1 is applied to the individual electrode 12. As a result, an electrical potential difference occurs between the individual electrode 12 and the ink in the individual ink flow passage 10, and the wetting angle of the ink at the surface of the insulating layer 15 is decreased to a value equal to or less than the critical wetting angle. Consequently, the ink flows into a portion where the individual electrode 12 faces the insulating layer 15, and the ink is discharged from the discharge port 10*a* to a recording sheet P.

At this time, the wetting angle of the ink at the surface of the insulating layer 15 is equal to or smaller than the wetting angle at the surface of the insulating layer 16. Thus, the ink is transported smoothly in the individual ink flow passage 10. In this illustrative embodiment, when the insulating layer 15 is disposed on the front end of the upper surface of the substrate 11, by setting the wetting angle of the ink at the surface of the insulating layer 15 to be smaller than the wetting angle at the surface of the insulating layer 16, the ink is transported smoothly compared with the case where the surface of the insulating layer 15 and the surface of the insulating layer 16 have the same wetting angle. Furthermore, since the wiring portions 13 are disposed between the adjacent individual ink flow passages 10 and such sections are covered with the partition walls 22, when the drive potential V1 is applied to the individual electrodes 12, the wetting angle does not change at the parts of the insulating layer 16 exposed to the individual ink flow passages 10. Furthermore, since the ink in the individual ink flow passage 10 is maintained at ground potential by the common electrode 17, the electrical potential difference between the ink in the individual ink flow passage 10 and the individual electrode 12 does not easily change, thus enabling stable operation.

When the drive potential V1 is applied to the individual electrode 12, the wetting angle of the ink at the surface of the insulating layer 15 is equal to the wetting angle of the ink at the insulating layer 16. Consequently, when an electrical potential that is smaller than the drive potential V1 is applied to the individual electrode 12 (i.e., when the electrical potential difference between the individual electrode 12 and the ink in the individual ink flow passage 10 is smaller than the predetermined potential difference), the wetting angle of the ink at the surface of the insulating layer 15 is larger than the wetting angle of the ink at the surface of the insulating layer 16, and the meniscus of the ink in the individual ink flow passage 10 stops at the edge of the insulating layer 15 proximal to the insulating layer 16.

According to the first illustrative embodiment described above, since all of the individual electrodes 12, the wiring portions 13, and the terminals 14 are disposed on the upper surface of the substrate 11, these components can be connected to each other on the upper surface of the substrate 11. Consequently, it is not necessary to form through-holes in the substrate 11. Thus, it is possible to simplify the structure of the ink transport head 1, and the manufacturing cost can be reduced. Furthermore, since the wiring portions 13 are covered with the insulating layer 16, it is possible to prevent the ink in the individual ink flow passages 10 from being brought into contact with the wiring portions 13.

Furthermore, when an electrical potential that is less than the drive potential V1 is applied to the individual electrode 12 (i.e., when the electrical potential difference between the individual electrode 12 and the ink in the individual ink flow passage 10 is smaller than the predetermined potential difference), the wetting angle of the ink at the surface of the insulating layer 15 is larger than the wetting angle of the ink at the surface of the insulating layer 16. Consequently, when the ink is not discharged from the discharge port 10*a*, it is possible to stop the meniscus in the individual ink flow passage 10 at the edge of the insulating layer 15 proximal to the insulating layer 16.

Furthermore, the wiring portions 13 are disposed between the adjacent individual ink flow passages 10 and the parts of the insulating layer 16 covering the wiring portions 13 are covered with the partition walls 22. Consequently, when the drive potential V1 is applied to the individual electrode 12, the wetting angle of the ink at the portion covered with the insulating layer 16 in the individual ink flow passage 10 does not change.

Furthermore, the common ink flow passage 9 is disposed in the ink transport head 1, and the ink is supplied from the common ink flow passage 9 to the individual ink flow passages 10. Consequently, by supplying the ink from the ink tank 5 through the tube 4 to the common ink flow passage 9, it is possible to easily supply the ink to the individual ink flow passages 10.

Furthermore, since the wetting angle of the ink at the surface of the insulating layer 15 is equal to the wetting angle at the surface of the insulating layer 16 when the drive potential V1 is applied to the individual electrode 12, the ink can be smoothly transported in the individual ink flow passage 10.

Furthermore, since the common electrode 17 is disposed in the common ink flow passage 9, the ink in the common ink flow passage 9 and the ink in the individual ink flow passages 10 can be maintained at ground potential. Consequently, the electrical potential difference between the ink and the individual electrodes 12 does not easily change, thus enabling stable operation.

Furthermore, since the width of the common electrode 17 in the sections where the common electrode 17 intersects with the wiring portions 13 is less than the length of the common electrode 17 in the direction in sections where the wiring portions 13 do not intersect with the common electrode 17, the area of the sections where the common electrode 17 overlaps the wiring portions 13 is decreased. Thus, it is possible to reduce the capacitance in a section in which the insulating layer 16 is interposed between each wiring portion 13 and the common electrode 17.

Modified illustrative embodiments in which various modifications are made to the above illustrative embodiment will be described below. The same reference numerals are used to designate components having a similar structure as the structure of the components in this illustrative embodiment, and the descriptions thereof are omitted.

Figure 6:
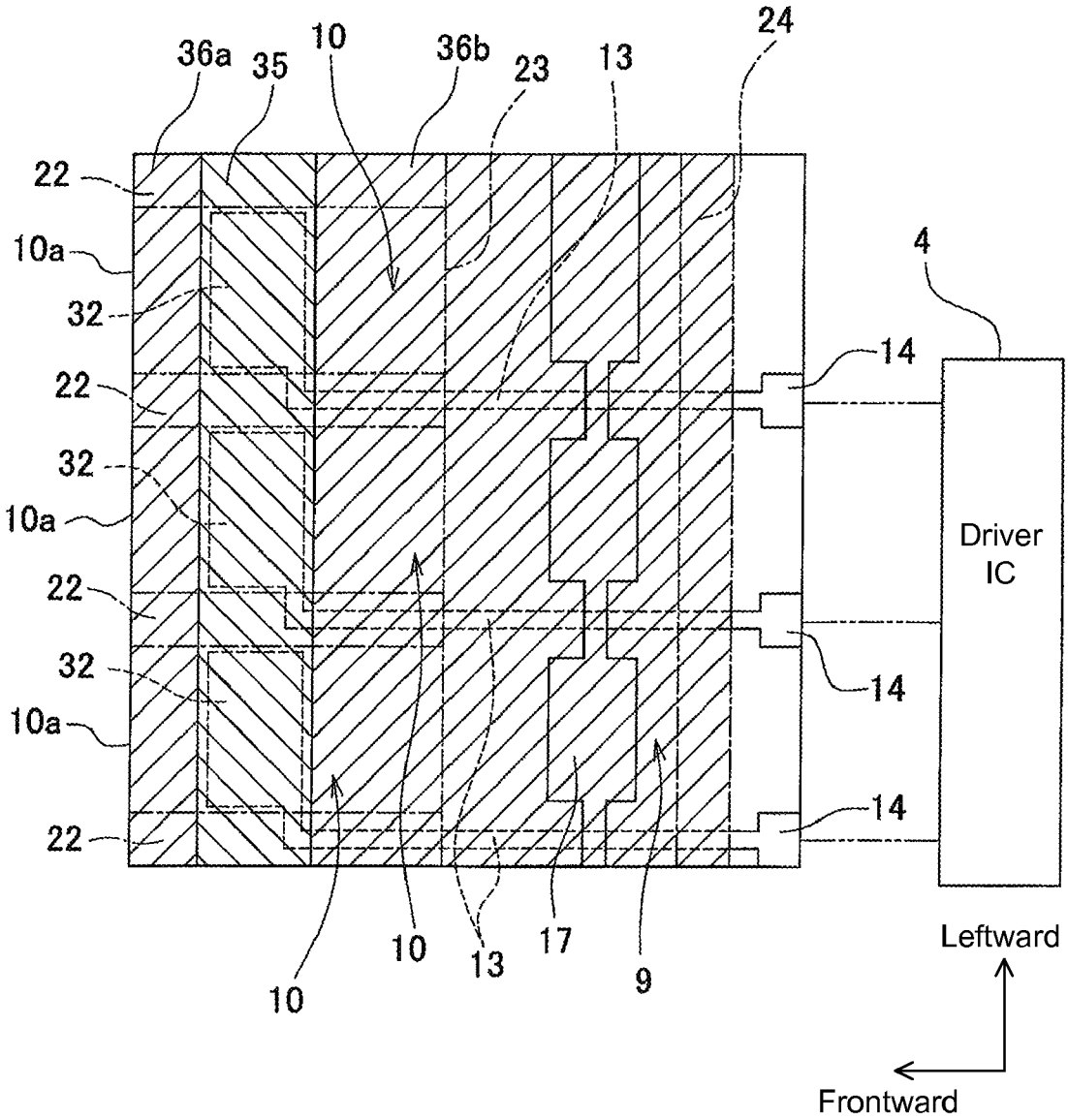
FIG. 6 is a plan view of a first modified illustrative embodiment, which corresponds to FIG. 3.

According to a modified illustrative embodiment, as shown in FIG. 6, individual electrodes 32 are disposed on the upper surface of the substrate 11 at positions slightly backward from the front end of the substrate 11, and an insulating layer 35 extends in the left-right direction so as to cover the individual electrodes 32, and insulating layers 36*a* and 36*b* are disposed in front and back regions in contact with the insulating layer 35, respectively (first modified illustrative embodiment). In certain aspects insulating layer 36*a* can be adjacent to insulating layer 35 as opposed to in contact. The insulating layer 35 is composed of the same insulating material as the insulating layer 15 (refer to FIG. 2), and the insulating layers 36*a* and 36*b* may be composed of the same insulating material as the insulating layer 16 (refer to FIG. 2).

Figure 7A:
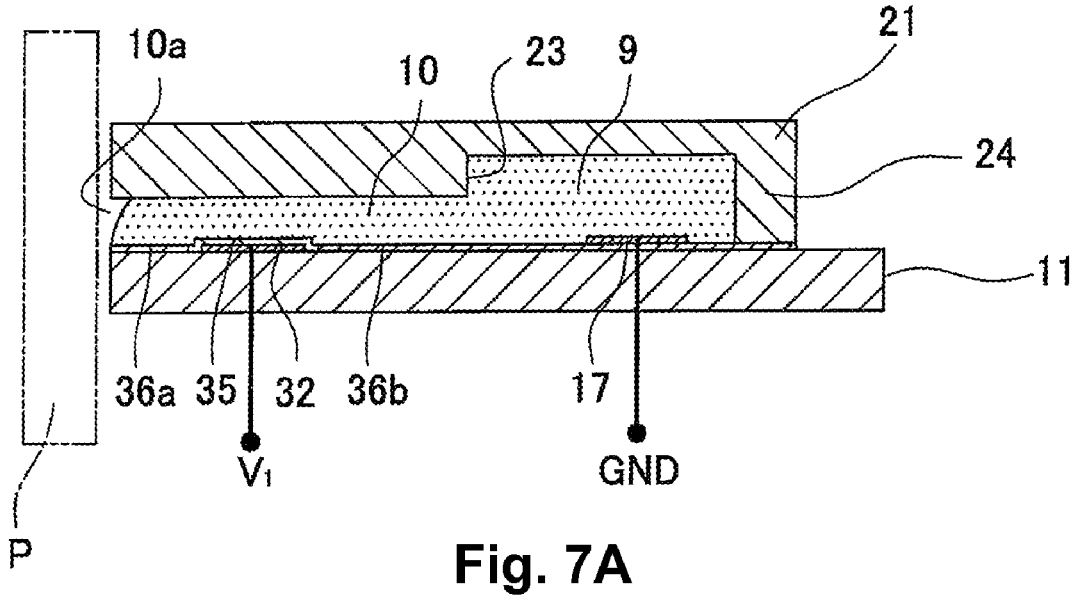
FIGS. 7A and 7B are sectional views of the first modified illustrative embodiment, which correspond to FIGS. 5A and 5B.

In such a case, when the ink is not discharged from the discharge port 10*a*, as shown in FIG. 7A, a drive potential V1 is applied to the individual electrode 32, and the wetting angle of the ink at the surface of the insulating layer 35 in the regions facing the individual electrodes 32 is decreased to the critical wetting angle or less. Thus, the ink is located in the common ink flow passage 9 and over the entire regions of the individual ink flow passages 10. A meniscus is formed at the discharge port 10*a*, and the ink is not discharged from the discharge port 10*a*.

Figure 7B:
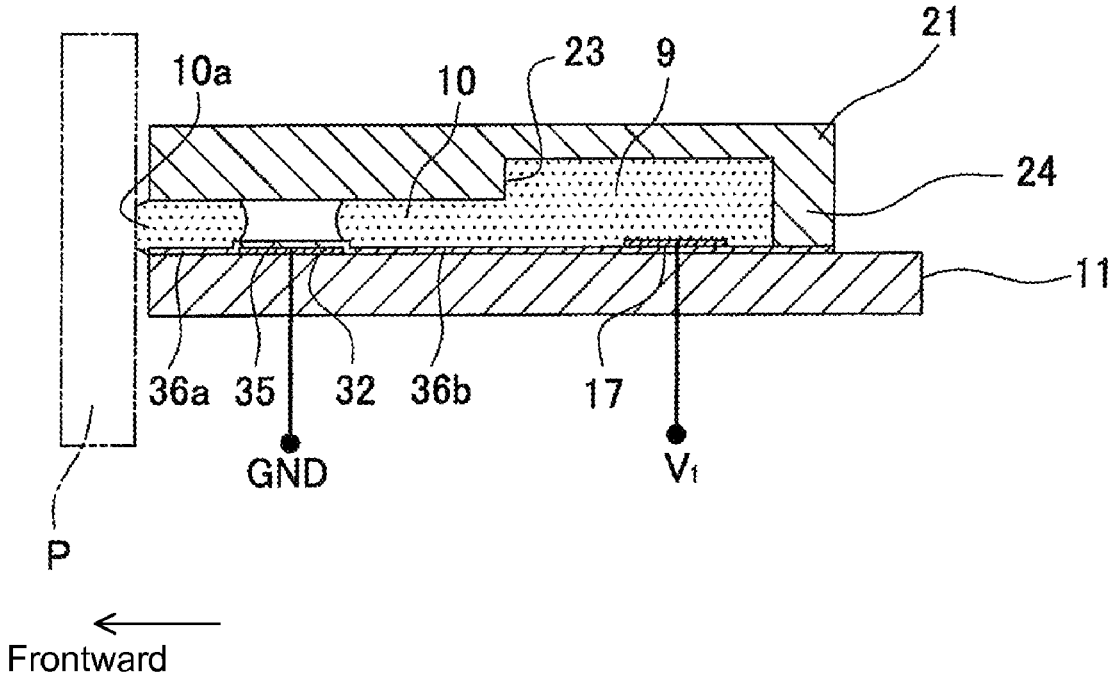

When the ink is discharged from the discharge port 10*a*, as shown in FIG. 7B, a ground potential is applied to an individual electrode 32 corresponding to the discharge port 10*a* from which the ink is to be discharged. As a result, the wetting angle of the ink on the surface of the insulating layer 35 in a region facing the individual electrode 32 is increased to larger than the critical wetting angle, and the ink that has stayed on the insulating layer 35 in the individual ink flow passage 10 moves toward regions in which the wetting angle of the ink is smaller and in which the insulating layers 36*a* and 36*b* are disposed, i.e., moves forward and backward in the individual ink flow passage 10. The ink that has stayed on the region facing the insulating layer 36*a* of the individual ink flow passage 10 is pushed by the ink that has moved forward in the individual ink flow passage 10 and is discharged from the discharge port 10*a* onto the recording sheet P.

In the first modified illustrative embodiment, a back pressure may be applied to the ink in the individual ink flow passage 10, the back pressure being smaller than the surface tension of the ink at the discharge port 10*a* when the ink is not discharged from the discharge port 10*a*. However, according to one illustrative aspect, the ink tank 5 (refer to FIG. 1) is placed at substantially the same level as the common ink flow passage 9, and a back pressure is not applied to the ink in the individual ink flow passage 10.

Figure 8:
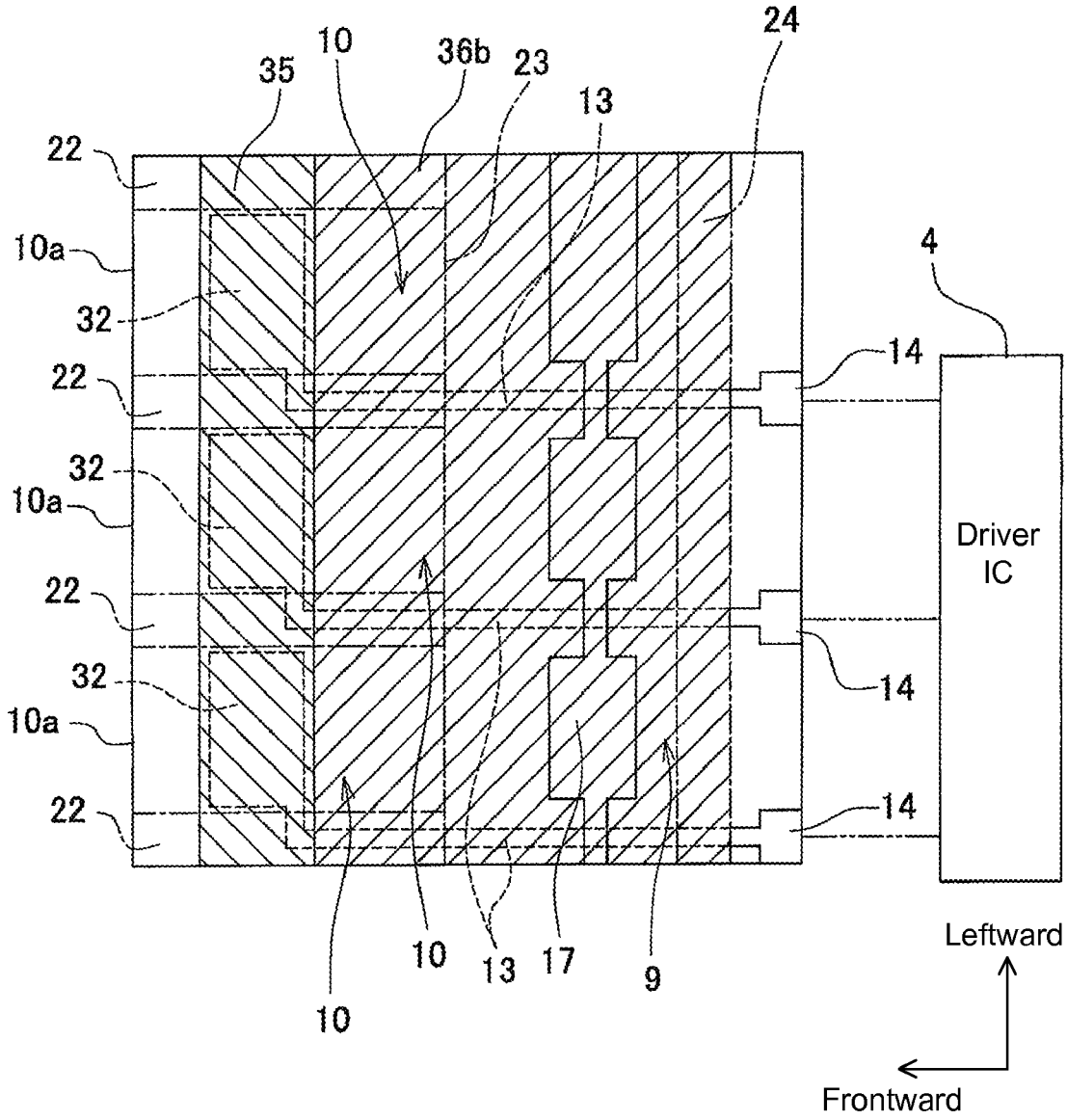
FIG. 8 is a plan view of a second modified illustrative embodiment, which corresponds to FIG. 3.

In the first modified illustrative embodiment, the insulating layers 36*a* and 36*b* are disposed in front of and at the back of the insulating layer 35, respectively. As shown in FIG. 8, an arrangement may be employed in which an insulating layer 36*b* is disposed at the back of an insulating layer 35, and an insulating layer is not disposed in front of the insulating layer 35 (second modified illustrative embodiment).

Figure 9:
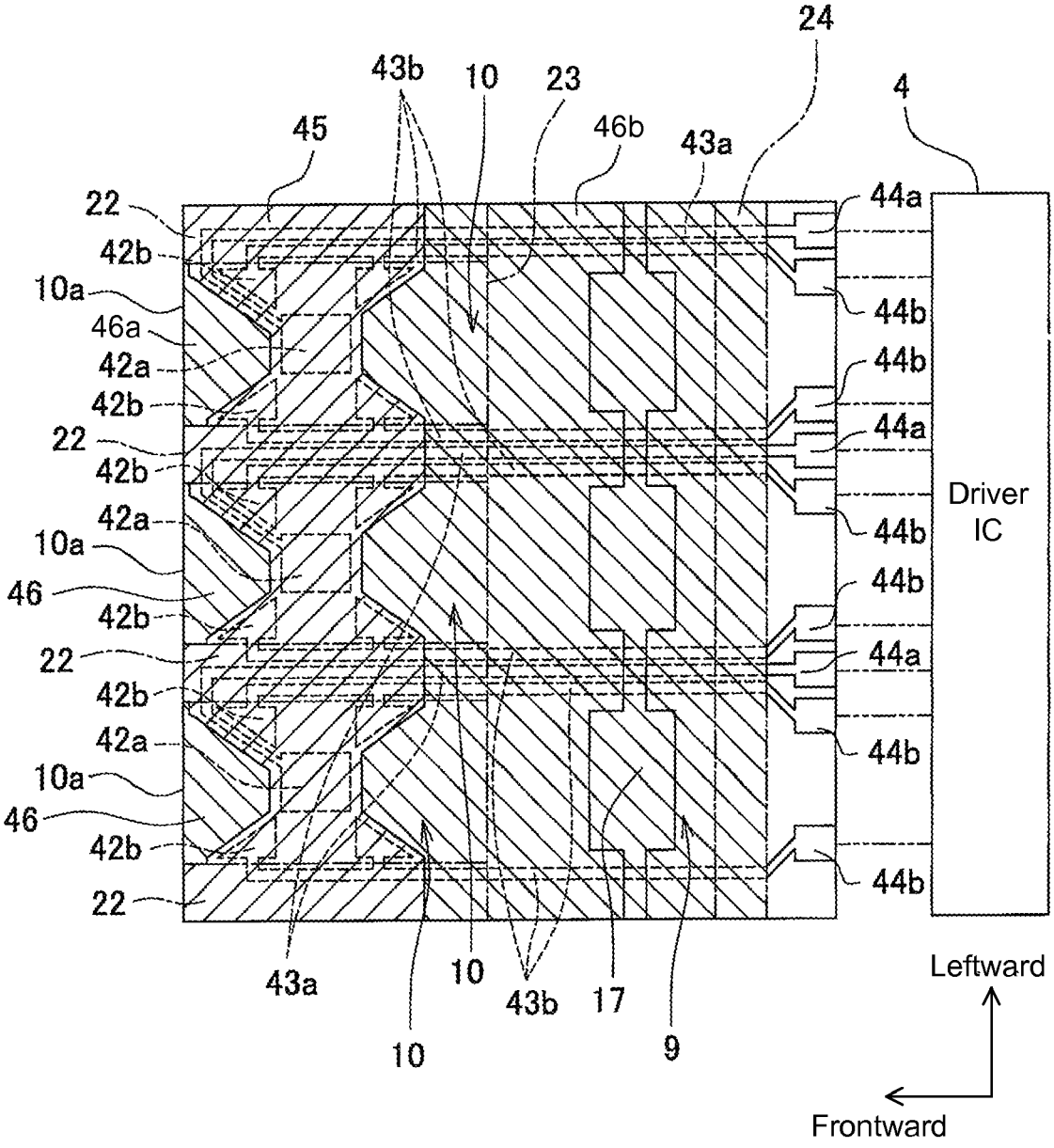
FIG. 9 is a plan view of a third modified illustrative embodiment, which corresponds to FIG. 3.

In another modified illustrative embodiment, as shown in FIG. 9, an individual electrode 42*a* is disposed slightly at the back of the front end of each individual ink flow passage 10 and in a central portion with respect to the front-back direction, the individual electrode 42*a* having a substantially rectangular planar shape. Individual electrodes 42*b*, each having a substantially right-angled triangular planar shape, are disposed outside the four corners of each individual electrode 42*a*. The individual electrodes 42*a* are connected to a driver IC 4 through wiring portions 43*a* and terminals 44*a*, and the individual electrodes 42*b* are connected to the driver IC 4 through wiring portions 43*b* and terminals 44*b* so that a ground potential or a drive potential V1 is selectively applied thereto. An insulating layer 45 extends in the left-right direction so as to cover the individual electrodes 42*a* and 42*b*, and insulating layers 46*a* and 46*b* are disposed in front and back regions, respectively, in contact with the insulating layer 45. The insulating layer 46*b* covers the wiring portions 43*a* and 43*b* (third modified illustrative embodiment). In certain aspects insulating layer 46*a* can be adjacent to insulating layer 45 as opposed to in contact. The insulating layer 45 is composed of the same insulating material as the insulating layer 15 (refer to FIG. 2), and the insulating layers 46*a* and 46*b* are composed of the same insulating material as the insulating layer 16 (refer to FIG. 2).

Figure 10A:
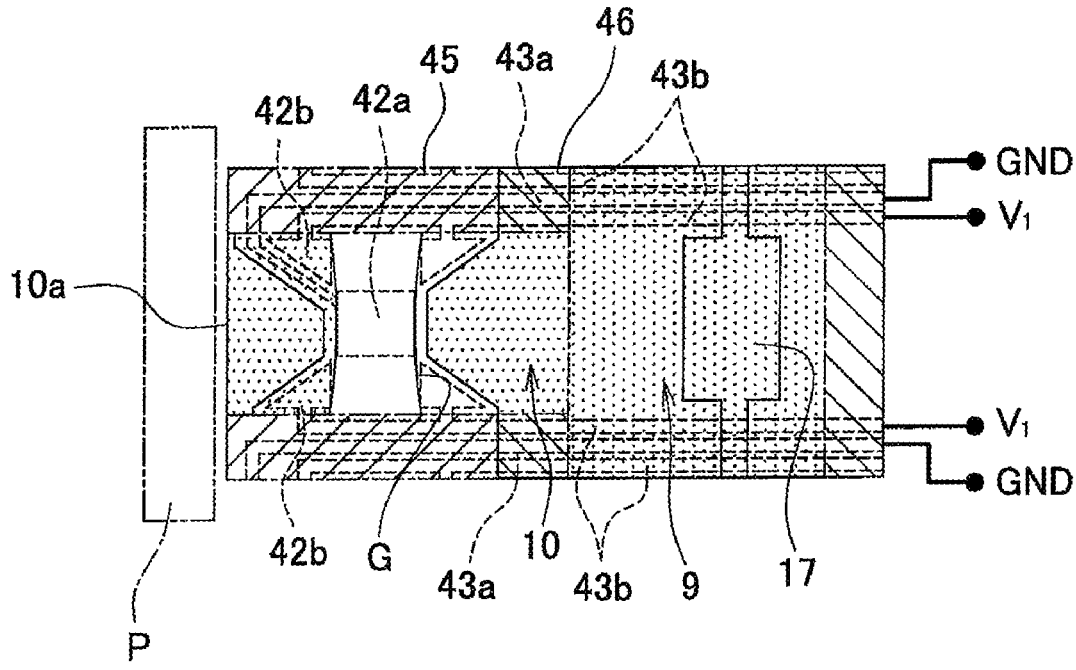
FIGS. 10A and 10B are plan views each showing an operation of an ink transport head according to the third modified illustrative embodiment.

In such a case, when the ink is not discharged, as shown in FIG. 10A, the ground potential is applied to the individual electrode 42*a* and the drive potential V1 is applied to the individual electrodes 42*b* by the driver IC 4. As a result, the wetting angle of the ink in regions facing the individual electrodes 42*b* is equal to or smaller than the critical wetting angle, and the wetting angle of the ink in the other region on the insulating layer 45 is larger than the critical wetting angle. Consequently, the ink is present only in a region facing the individual electrodes 42*b* in the section of the individual ink flow passage 10 facing the insulating layer 45. A bubble G is present in a region extending in the left-right direction including the region facing the individual electrode 42*a* in the section of the individual ink flow passage 10 facing the insulating layer 45. The ink in the individual ink flow passage 10 is blocked by the bubble G from flowing to the discharge port 10*a*.

Figure 10B:
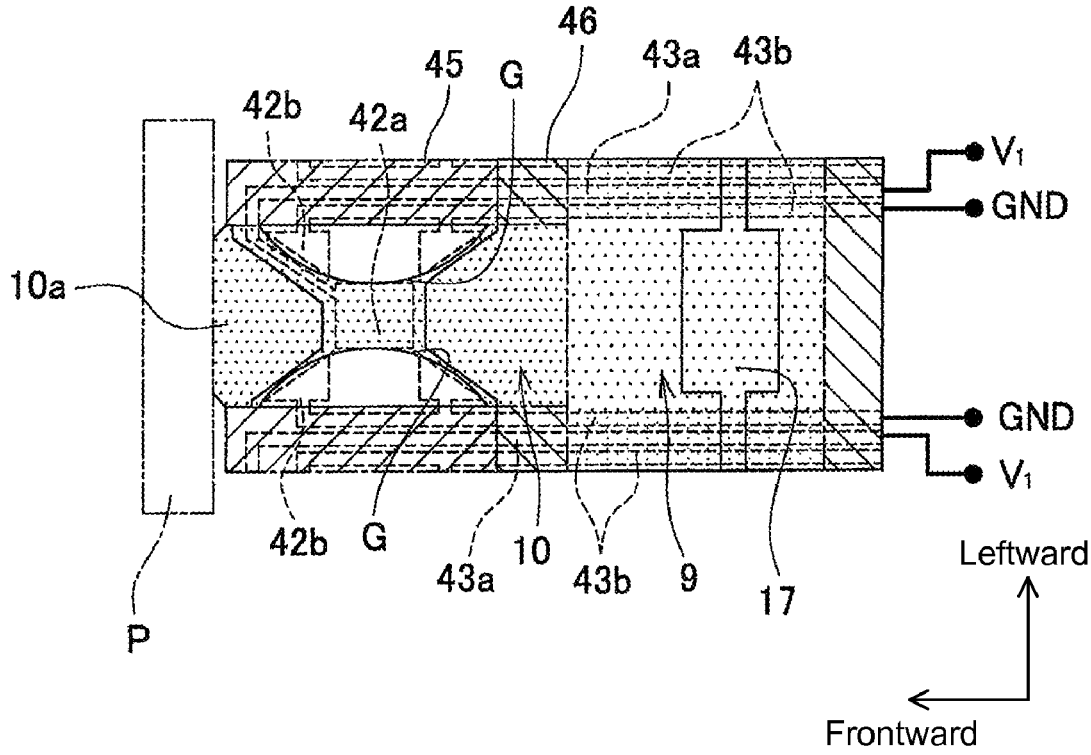

When the ink is discharged from the discharge port 10*a*, as shown in FIG. 10B, the drive potential V1 is applied to the individual electrode 42*a*, and the ground potential is applied to the individual electrodes 42*b*. As a result, the wetting angle of the ink on the insulating layer 45 in regions facing the individual electrodes 42*b* is larger than the critical wetting angle, and the wetting angle of the ink on the insulating layer 45 in a region facing the individual electrode 42*a* is equal to or smaller than the critical wetting angle. Consequently, the ink moves, and the ink is present on the insulating layer 45 only in the section facing the individual electrode 42*a* in the region where the individual ink flow passage 10 overlaps the insulating layer 45. The bubble G in the individual ink flow passage 10 also moves. As a result, bubbles G are present in two regions which are located at both sides in the left-right direction of the individual electrode 42*a* and which extend in the front-back direction including the regions facing the individual electrodes 42*b* in the section of the individual ink flow passage 10 facing the insulating layer 45. Thus, the ink in the individual ink flow passage 10 is not blocked by the bubbles G, and the ink is discharged from the discharge port 10*a* to the recording sheet P.

Figure 11:
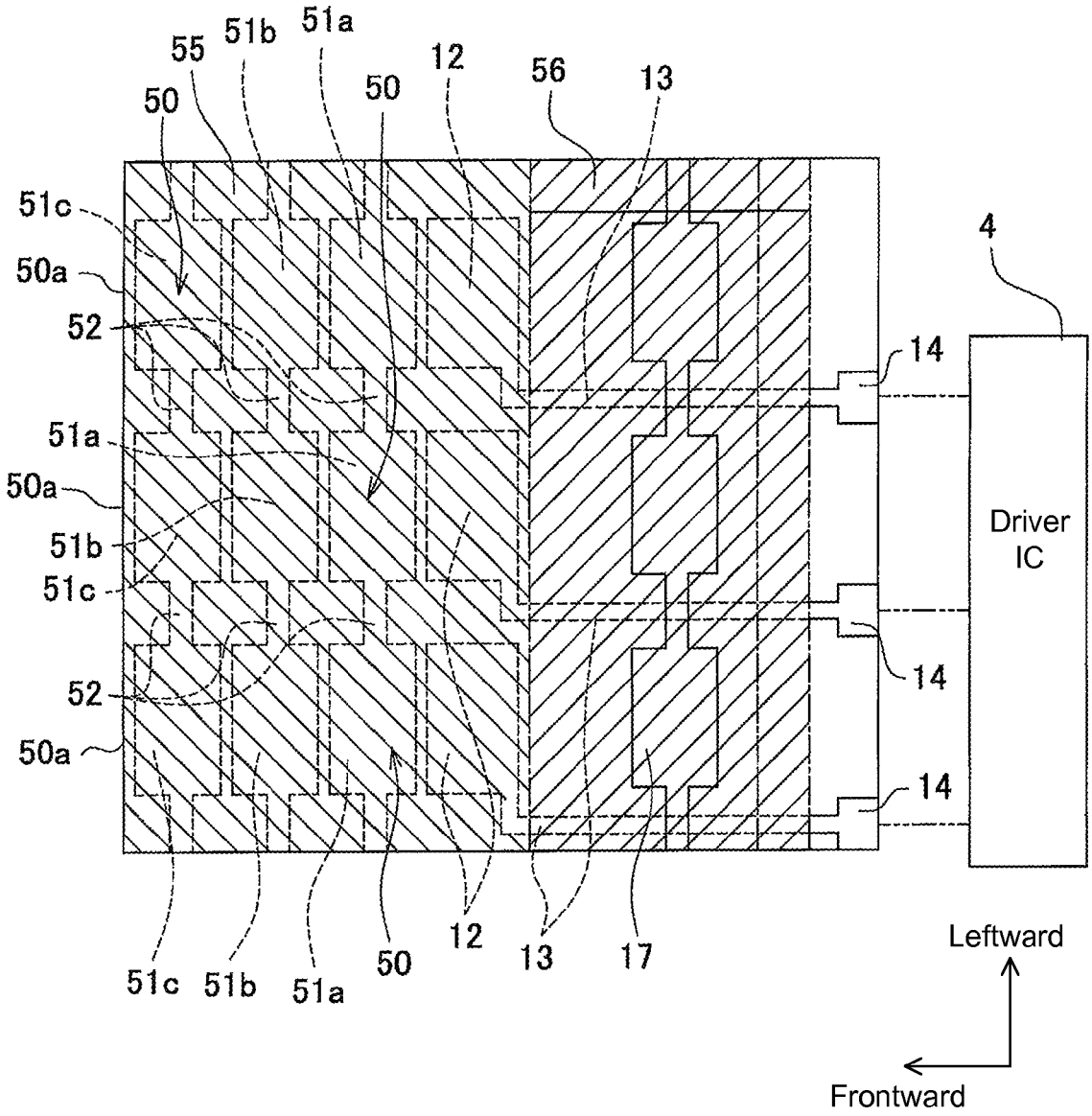
FIG. 11 is a plan view of a fourth modified illustrative embodiment, which corresponds to FIG. 3.

In another modified illustrative embodiment, as shown in FIG. 11, three electrodes 51*a*, 51*b*, and 51*c*, which are disposed a predetermined distance apart in the front-back direction in front of the individual electrode 12, are provided in each of the individual ink flow passages. The electrodes 51*a*, the electrodes 51*b*, and the electrodes 51*c*, which are arrayed in the left-right direction, are connected to each other by corresponding wiring portions 52. An insulating layer 55 is continuously disposed in regions extending in the front-back direction between the adjacent individual ink flow passages 50 with respect to the left-right direction, and in regions overlapping the individual electrodes 12 and the electrodes 51*a* and 51*b*, and 51*c* with respect to the front-back direction. An insulating layer 56 is disposed in a back region in contact with the insulating layer 55. The electrodes 51*a*, 51*b*, and 51*c* are connected to the driver IC 4 at positions on the upper surface of the substrate 11 (not shown), and are provided with either a drive potential V1 or a ground potential by the driver IC 4. Partition walls are not disposed between the adjacent individual ink flow passages 50 (fourth modified illustrative embodiment). The insulating layer 55 is composed of the same insulating material as the insulating layer 15 (refer to FIG. 2), and the insulating layer 56 is composed of the same insulating material as the insulating layer 16 (refer to FIG. 2).

Figure 12A:
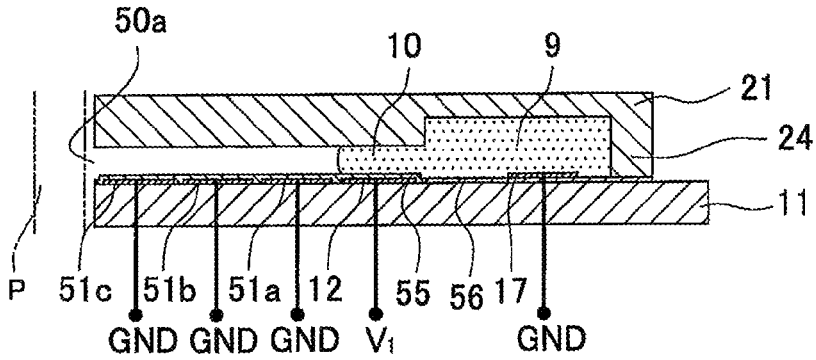
FIGS. 12A to 12D are sectional views each showing an operation of an ink transport head according to the fourth modified illustrative embodiment.

In such a case, when the ink is not discharged from the discharge port 50*a*, the ground potential is applied to each of the individual electrode 12 and the electrodes 51*a*, 51*b*, and 51*c*. In this state, as in the first illustrative embodiment, the ink does not flow into a portion of an individual ink flow passage 10 facing the insulating layer 55. In the process of discharging the ink as in the first illustrative embodiment, as shown in FIG. 12A, when the drive potential V1 is applied to the individual electrode 12, the ink in the common ink flow passage 9 flows onto the insulating layer 55 in a portion of the individual ink flow passage 10 facing the individual electrode 12.

Figure 12B:
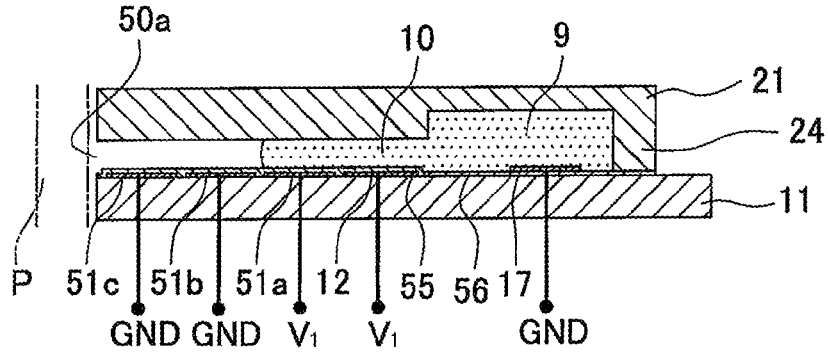
Figure 12C:
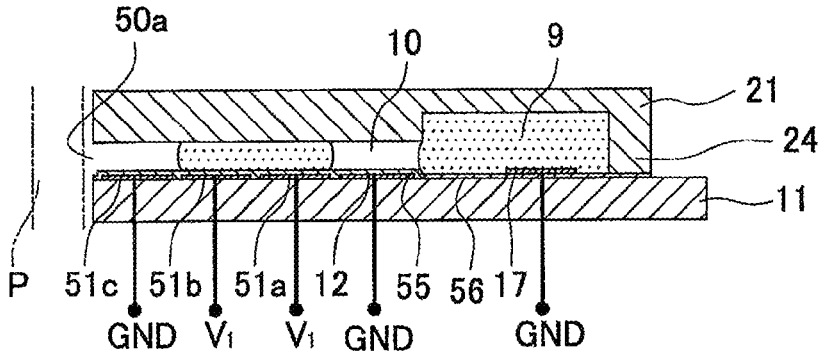

Next, as shown in FIG. 12B, when the drive potential V1 is applied to the electrode 51*a*, the ink further flows into a portion facing the electrode 51*a*. At the time when the ink flows into the portion of the individual ink flow passage 10 facing the electrode 51*a*, as shown in FIG. 12C, by setting the electrical potential of the individual electrode 12 back to the ground potential, the ink located at the portion of the individual ink flow passage 10 facing the individual electrode 12 moves in the front-back direction, and the ink located above the electrode 51*a* is separated from the ink in the common ink flow passage 9.

Figure 12D:
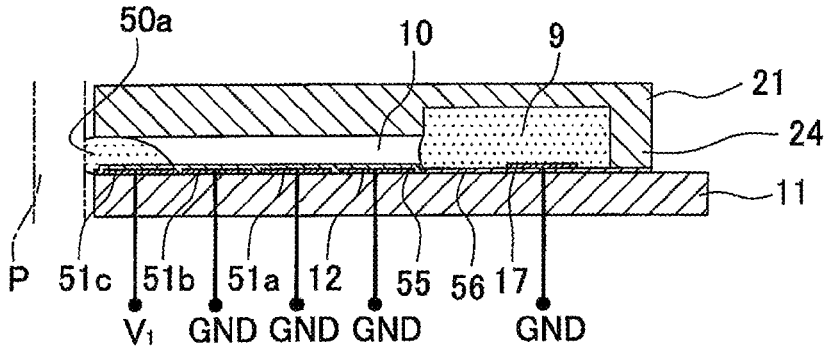

Then, the drive potential V1 is applied to the electrode 51*b*. At the time when the ink flows into a portion of the individual ink flow passage facing the electrode 51*b*, the electrical potential of the electrode 51*a* is set back to the ground potential. Then, the drive potential V1 is applied to the electrode 51*c*. At the time when the ink flows into a portion of the individual ink flow passage 10 facing the electrode 51*c*, the electric potential of the electrode 51*b* is set back to ground potential. Thereby, the ink moves to the portions of the individual ink flow passage 10 facing the electrodes 51*b* and 51*c*, successively. Finally, as shown in FIG. 12D, the ink is discharged from the discharge port 50*a* to the recording sheet P. In the fourth modified illustrative embodiment, the electrodes 51*a*, the electrodes 51*b*, and the electrodes 51*c*, which lie adjacent to each other in the left-right direction, are connected to each other. However, an arrangement may be used in which these electrodes are not connected to each other and are individually connected to the driver IC 4.

Figure 13:
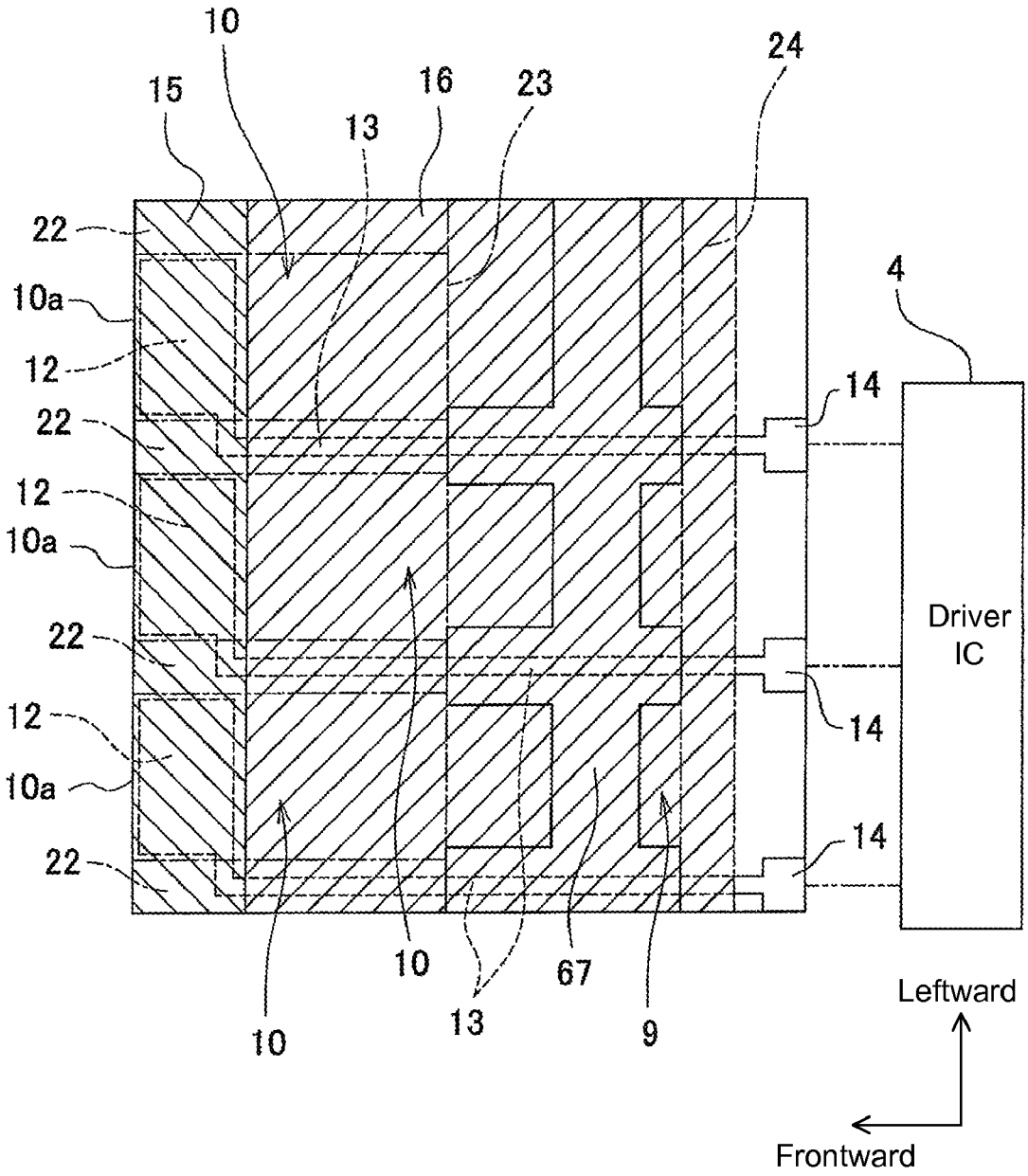
FIG. 13 is a plan view of a fifth modified illustrative embodiment, which corresponds to FIG. 3.

In another modified illustrative embodiment, as shown in FIG. 13, a common electrode 67 extends in the left-right direction. The common electrode 67 also extends in the front-back direction at positions overlapping regions between the adjacent individual ink flow passages 10 with respect to the left-right direction, and the common electrode 67 completely covers the insulating layer 15 in the common ink flow passage 9 (fifth modified illustrative embodiment). In such a case, in the common ink flow passage 9, portions of the insulating layer 16 covering the wiring portions 13 are not exposed. Consequently, even if the electrical potential of the wiring portions 13 is changed, and the wetting angle of the ink in the portions of the insulating layer 16 facing the wiring portions 13 is changed, the movement of the ink in the common ink flow passage 9 can be prevented from being affected by such a change.

Figure 14:
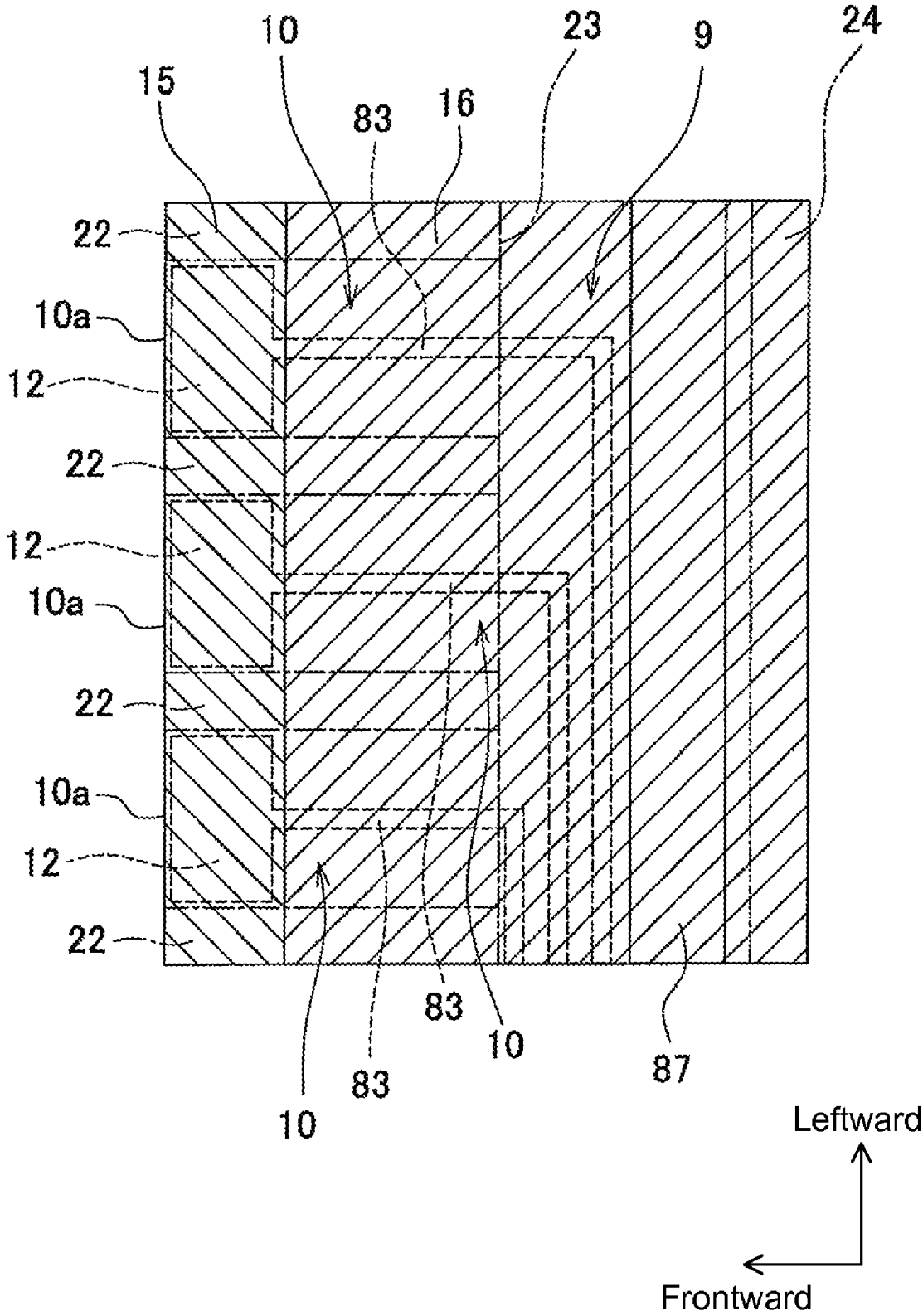
FIG. 14 is a plan view of a sixth modified illustrative embodiment, which corresponds to FIG. 3.

In another modified illustrative embodiment, as shown in FIG. 14, each of the wiring portions 83 extends from a central portion of the back end of the corresponding individual electrode 12 toward the back, passes through the corresponding individual ink flow passage 10, and then is bent substantially at a right angle toward the right at a position in front of a common electrode 87. The common electrode 87 extends in the left-right direction with a constant width (sixth modified illustrative embodiment). Even in this case, the wiring portions 83 are connected to a driver IC at positions on the right side (not shown), and electrical potentials are applied to each of the individual electrodes 12 by the driver IC. In such a case, since wiring portions are not disposed between the adjacent individual ink flow passages 10, it is possible to increase the degree of integration of the individual ink flow passages 10 by decreasing the distance between the adjacent individual ink flow passages 10.

Furthermore, in such a case, since the wiring portions 83 and the common electrode 87 do not overlap each other, it is possible to prevent extra capacitance from occurring in the insulating layer 16. Furthermore, since the wiring portions 83 are arranged so as not to intersect with the common electrode 87, unlike the first illustrative embodiment, it is not necessary for any portion of the width of the common electrode 87 to be decreased to decrease the capacitance in the insulating layer 85. Thus, the common electrode 87 can be formed easily.

A second illustrative embodiment of the present invention will now be described. The second illustrative embodiment relates to another example in which the present invention is applied to a printer that performs printing by transporting ink to a recording sheet. In a printer according to the second illustrative embodiment, the ink transport head 1 of the printer 100 shown in FIG. 1 is replaced with an ink transport head 101. The ink transport head 101 will be described below.

Figure 15:
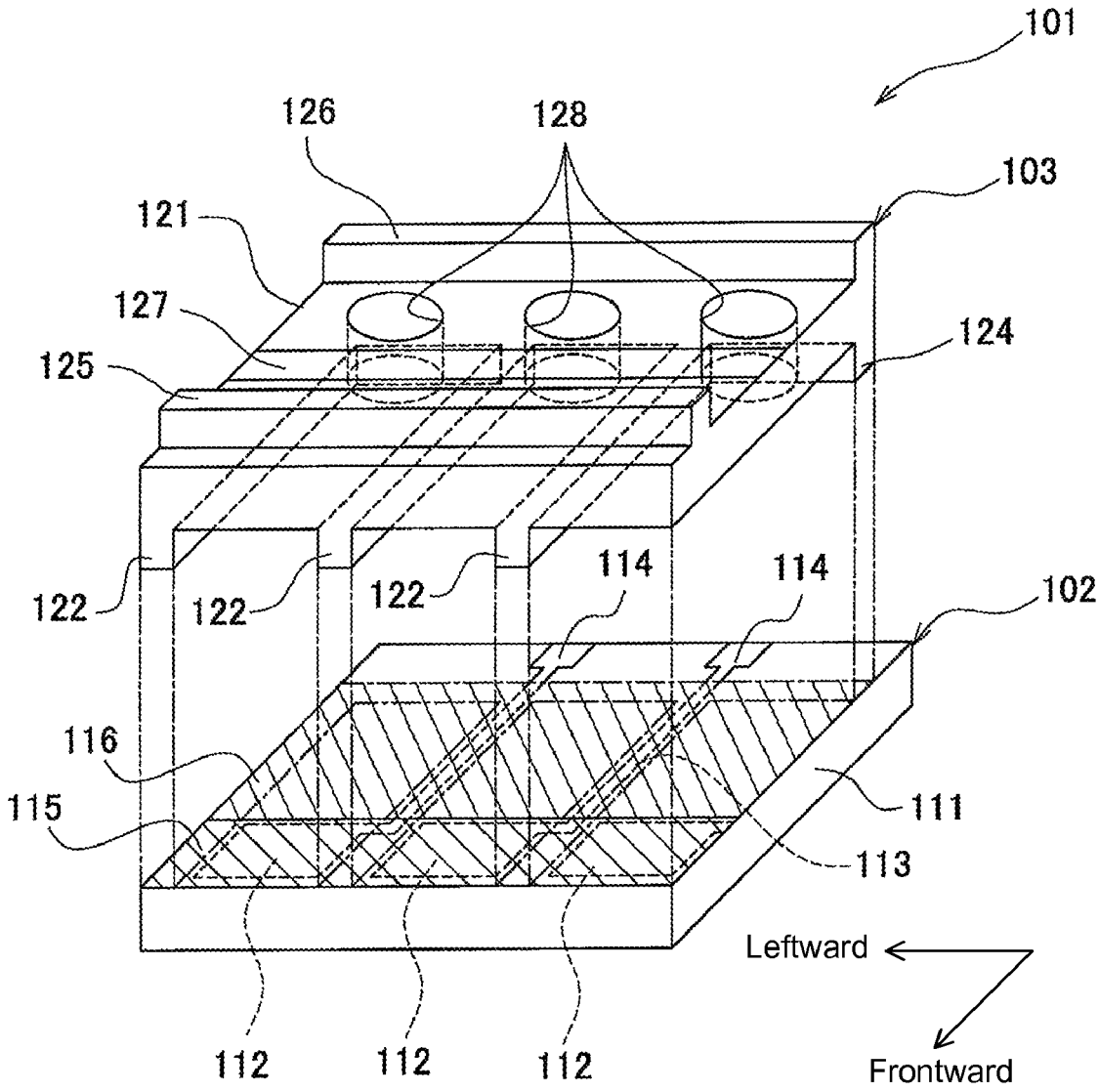
FIG. 15 is an exploded perspective view showing a part of an ink transport head according to a second illustrative embodiment, which corresponds to FIG. 2.
Figure 16:
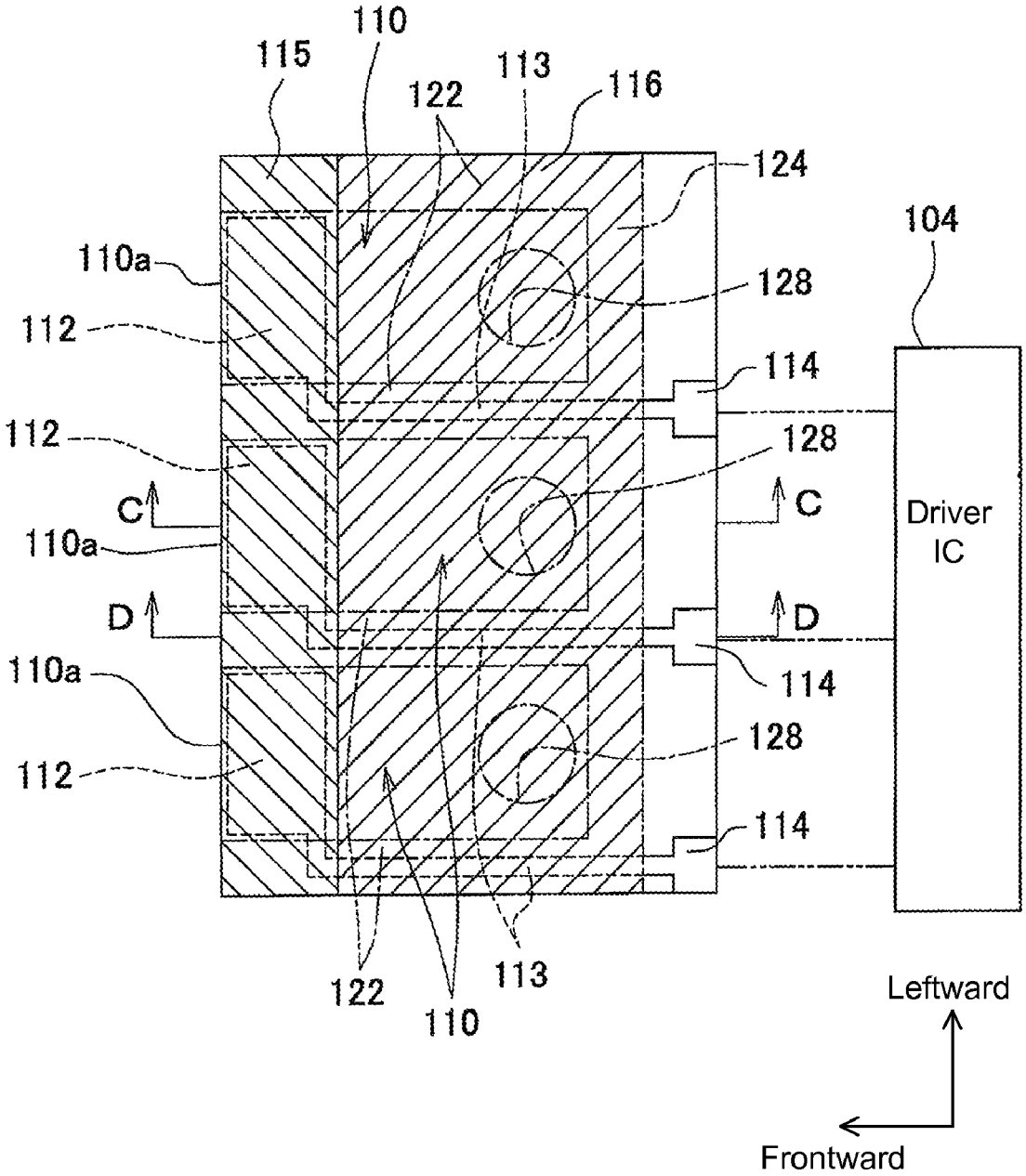
FIG. 16 is a plan view showing the ink transport head shown in FIG. 15.
Figure 17A:
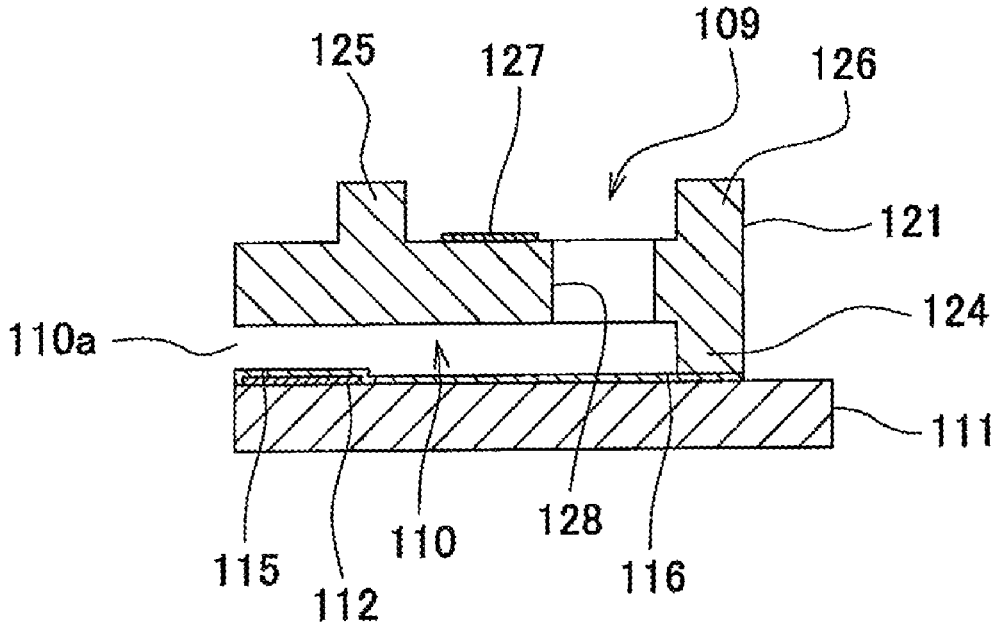
FIG. 17A is a sectional view taken along the line C-C of FIG. 16.
Figure 17B:
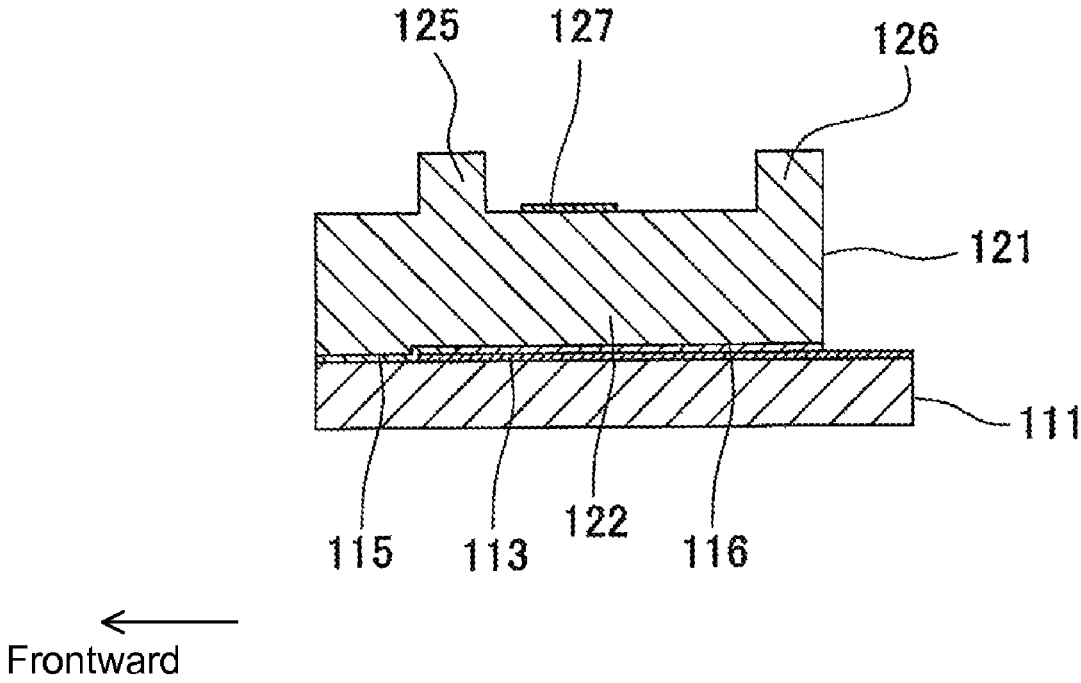
FIG. 17B is a sectional view taken along the line D-D of FIG. 16.

FIG. 15 is an exploded perspective view showing a part of the ink transport head 101 according to the second illustrative embodiment, which corresponds to FIG. 2. FIG. 16 is a plan view of FIG. 15. FIG. 17A is a sectional view taken along the line C-C of FIG. 16, and FIG. 17B is a sectional view taken along the line D-D of FIG. 16.

As shown in FIGS. 15 to 17B, the ink transport head 101 includes a lower member 102 constituting a substantially lower half portion and an upper member 103 constituting a substantially upper half portion, the lower member 102 and the upper member 103 being bonded to each other. Discharge ports 110*a* are disposed on the front end. Individual ink flow passages 110 extend in the front-back direction between the lower member 102 and the upper member 103, the individual ink flow passages 110 being equally spaced in the left-right direction. A common ink flow passage 109 extending in the left-right direction is disposed on the upper member 103. That is, the common ink flow passage 109 is disposed on a plane that is different from the upper surface of a substrate 111 on which the individual ink flow passages 110 are disposed.

The lower member 102 includes individual electrodes 112, wiring portions 113, terminals 114, and insulating layers 115 and 116 disposed on an upper surface of the substrate 111. The substrate 111 is a plate-like body having a substantially rectangular planar shape composed of an insulating material, such as silicon, polyimide, polyamide, or polyacetal.

The individual electrodes 112 each have a substantially rectangular planar shape and are disposed at a predetermined distance apart from each other in the left-right direction on the front end of the upper surface of the substrate 111 so as to correspond to the individual ink flow passages 110.

Each of the wiring portions 113 extends rightward from the right back corner of the corresponding individual electrode 112 to a region between the adjacent individual electrodes 112. Each wiring portion 113 is bent substantially at a right angle toward the back, and extends to a terminal 114 disposed on the back end of the upper surface of the substrate 111. That is, the wiring portions 113 extend from the individual electrodes 112 toward the upstream side of the transport direction of the ink in the individual ink flow passages 10. Since the common ink flow passage 109 is disposed on a plane that is different from the upper surface of the substrate 111, it is not necessary to arrange the wiring portions 113 so as to avoid the common ink flow passage 109. As a result more arrangement configurations of the wiring portions 113 may exist.

The terminals 114 each have a substantially rectangular planar shape and are disposed on the back end of the substrate 111 at positions overlapping the wiring portions 113 in a plan view. The terminals 14 are connected to a driver IC 104 as shown in FIG. 16. A ground potential or a drive potential V1 is selectively applied by the driver IC 104 to each of the individual electrodes 112 through the terminals 114 and the wiring portions 113. According to such an arrangement, since the wiring portions 113 extend toward the upstream side in the transport direction of ink in the individual ink flow passages 110 and the terminals 114 are disposed on the back end of the substrate 111, even when many individual electrodes 112 are highly integrated, it is possible to perform connection to the driver IC 104 by the terminals 114 disposed on the back end of the substrate 111. Note that the driver IC 104 may be disposed on the back end of the upper surface of the substrate 111 and not directly connected to the terminals 114, and may be connected to the terminals 114 through a flexible printed circuit board (FPC) or the like (not shown).

The individual electrodes 112, the wiring portions 113, and the terminals 114 are each composed of a conductive material, such as a metal, and can be formed by screen-printing, sputtering, vapor deposition, or the like. The individual electrodes 112, the wiring portions 113, and the terminals 114 are disposed on the upper surface of the substrate 111. As such, these components can be connected to each other on the upper surface of the substrate 111. Consequently, it is not necessary to form through-holes in the substrate 111 in order to connect these components to each other. Thus, the structure of the ink transport head 101 can be simplified, and the manufacturing cost can be reduced. Furthermore, since all of the individual electrodes 112, the wiring portions 113, and the terminals 114 are disposed on the upper surface of the substrate 111, these components can be formed at one time by the method described above.

The insulating layer 115 is composed of an insulating material, such as a fluorocarbon resin, that is different from the substrate 111. The insulating layer 115 extends in the left-right direction at the front end on the upper surface of the substrate 111 so as to cover the individual electrodes 112. The insulating layer 115 is formed by a method in which an insulating material is applied by spin coating to the entire region of the upper surface of the substrate 111, and then unnecessary portions can be removed by laser. Alternatively, a method may be employed in which a mask is applied to the upper surface of the substrate 111, and the insulating layer 115 is formed by CVD, or a method may be employed in which an insulating material is coated on the upper surface of the substrate 111 to form the insulating layer 115.

The insulating layer 116 is composed of an insulating material, such as alumina, that is different from the insulating layer 115. The insulating layer 116 extends continuously from a region in contact with the back or edge of the insulating layer 115 (with respect to the transport direction of the ink) with respect to the front-back direction (i.e., a region adjacent to the region where the insulating layer 115 is arranged) to a portion slightly in front of the terminals 114 so as to cover the individual ink flow passages 110. The insulating layer 116 is formed by an aerosol deposition method (AD method) in which deposition is performed by spraying fine particles of insulating material onto the substrate 111. In addition, the insulating layer 116 can also be formed by CVD, sputtering, or the like. In such a case, since the insulating layer 116 is formed in the continuous regions on the upper surface of the substrate 11, the insulating layer 116 can be formed at one time by the method described above.

The upper member 103 includes partition walls 122 and a partition wall 124 disposed on a lower surface of a substrate 121, and partition walls 125 and 126 and a common electrode 127 disposed on an upper surface of the substrate 121. Through-holes 128 passing through the substrate 121 are disposed. The substrate 121 is a plate-like body which has a substantially rectangular planar shape with a length with respect to the front-back direction being slightly smaller than a length of the substrate 111. The substrate 121 is composed of the same insulating material as the substrate 21, such as silicon or polyimide.

The partition walls 122 protrude downward from regions of the lower surface of the substrate 121 overlapping regions between adjacent individual ink flow passages 110 in a plan view, and extend from the front end of the substrate 121 in the front-back direction toward the back end. The partition wall 124 protrudes downward in a plan view from the back end of the lower surface of the substrate 121 to a position at the same level as the lower end of each partition wall 122 and extends with a length substantially equal to the overall length of the substrate 121 with respect to the left-right direction. The back ends of the partition walls 122 are connected to the partition wall 124 and the partition walls 122 and the partition wall 124 are integrated into each other. When the lower member 102 and the upper member 103 are bonded to each other, spaces surrounded by the upper surface of the substrate 111, the lower surface of the substrate 121, the partition walls 122, and the partition wall 124 serve as the individual ink flow passages 110.

The partition wall 125 protrudes upward from an area proximal to the front end of the upper surface of the substrate 121 and extends with a length substantially equal to the overall length of the substrate 121 with respect to the left-right direction. The partition wall 126 protrudes upward from the back end of the upper surface of the substrate 121 and extends with a length substantially equal to the overall length of the substrate 121 with respect to the left-right direction. A space surrounded by the upper surface of the substrate 121, the partition walls 125 and 126, and a member (not shown) located above the substrate 121 serves as the common ink flow passage 109.

The common electrode 127 extends on the upper surface of the substrate 121 in a region between the partition wall 125 and the partition wall 126, with a length substantially equal to the overall length of the substrate 121 with respect to the left-right direction. That is, the common electrode 127 is disposed on the surface of the common ink flow passage 109. The common electrode 127 is maintained at the ground potential, and thus, the ink in the common ink flow passage 109 is maintained at the ground potential. The common electrode 127 is composed of the same conductive material as each of the individual electrodes 112, the wiring portions 113, and the terminals 114 and similarly can be formed by screen-printing, sputtering, vapor deposition, or the like.

The through-holes 128 each have a substantially circular planar shape and are disposed between the common electrode 127 and the partition wall 126 at positions overlapping the central portions of the individual ink flow passages 110 in a plan view with respect to the left-right direction. The through-holes 128 vertically pass through the substrate 121, and the common ink flow passage 109 communicate with the individual ink flow passages 110 through the through-holes 128. Thus, the ink in the common ink flow passage 109 is supplied to the individual ink flow passages 110. Since the common ink flow passage 109 communicates with the individual ink flow passages 110, the ink in the individual ink flow passages 110 is maintained at ground potential.

A process in which ink is discharged to a recording sheet P by the ink transport head 101 will now be described with reference to FIGS. 18A and 18B, which are sectional views with each showing an operation of the ink transport head 101.

Figure 18A:
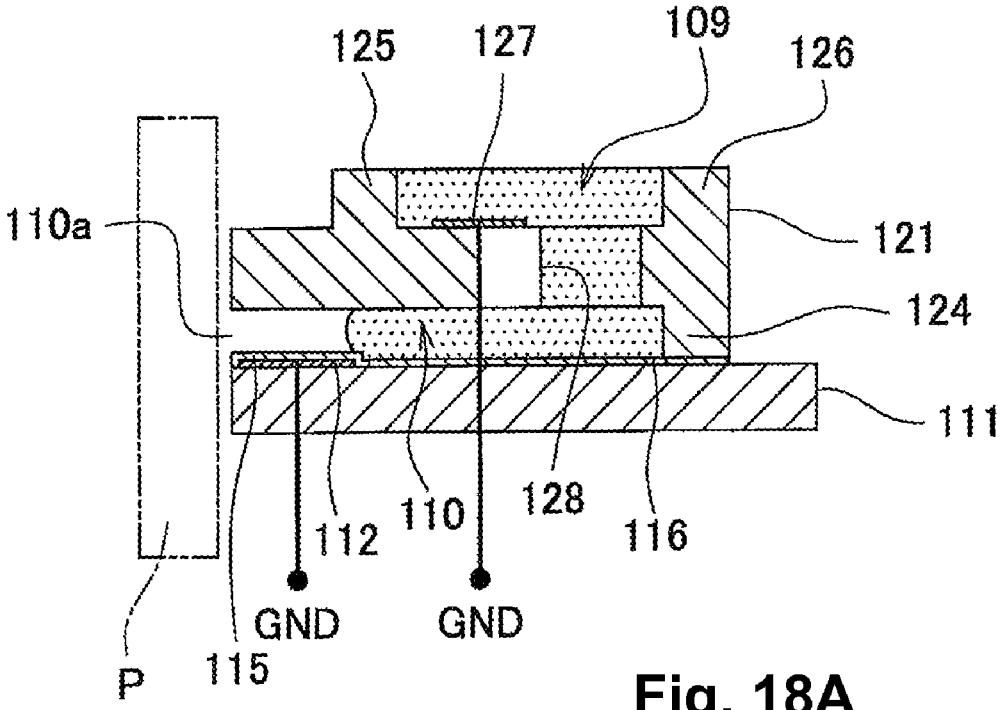
FIGS. 18A and 18B are sectional views each showing an operation of the ink transport head shown in FIG. 16.

In the ink transport head 101, when the ink is not discharged from the discharge port 110*a*, as shown in FIG. 18A, a ground potential is applied to the individual electrode 112, and there is no electrical potential difference between the individual electrode 112 and the ink in the individual ink flow passage 110, the ink being maintained at the ground potential. At this time, the wetting angle of the ink on the surface of the insulating layer 115 (e.g., 110°) is larger than the wetting angle of the ink on the upper surface of the substrate 116 (e.g., 60°) and is larger than a wetting angle (critical wetting angle) of the insulating layer 115 at which the ink can move from a portion of the individual ink flow passage 10 facing the insulating layer 116 to a portion of the individual ink flow passage 10 facing the insulating layer 115. Consequently, the meniscus of the ink in the individual ink flow passage 110 stops at an edge of the insulating layer 115 proximal to the insulating layer 116, and the ink does not flow into a portion of the individual ink flow passage 110 facing the insulating layer 115. Thus, the ink is not discharged from the discharge port 110*a*.

Figure 18B:
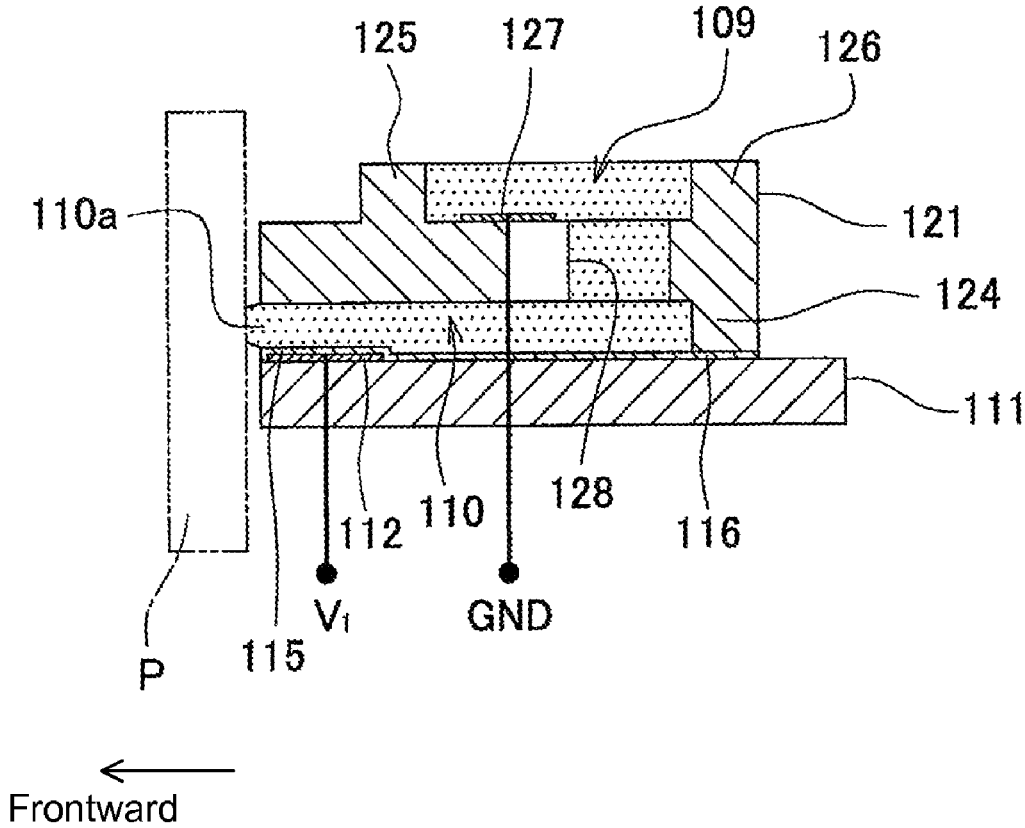

On the other hand, when the ink is discharged from the discharge port 110*a*, as shown in FIG. 18B, a drive potential V1 is applied to the individual electrode 112. As a result, an electrical potential difference occurs between the individual electrode 112 and the ink in the individual ink flow passage 110, and the wetting angle of the ink at the surface of the insulating layer 115 in the region facing the individual electrode 112 is decreased to a value equal to or less than the critical wetting angle. Consequently, the ink flows into a portion of the individual ink flow passage 110 facing the insulating layer 115, and the ink is discharged from the discharge port 110*a* to the recording sheet P.

At this time, the wetting angle of the ink at the surface of the insulating layer 115 is substantially equal to or smaller than the wetting angle at the surface of the insulating layer 116. Thus, the ink can be transported smoothly in the individual ink flow passage 110. Furthermore, since the wiring portions 113 are disposed between the adjacent individual ink flow passages 110 and such sections are covered with the partition walls 122, when the drive potential V1 is applied to the individual electrodes 112, the wetting angle does not change at portions of the insulating layer 116 exposed to the individual ink flow passages 110. Furthermore, since the ink in the individual ink flow passage 110 is maintained at ground potential by the common electrode 17, the electrical potential difference between the ink in the individual ink flow passage 110 and the individual electrode 112 does not easily change, thus enabling stable operation.

In the second illustrative embodiment, when the drive potential V1 is applied to the individual electrode 112, the wetting angle of the ink at the surface of the insulating layer 115 is equal to the wetting angle of the ink at the surface of the insulating layer 116. When an electrical potential that is less than the drive potential V1 is applied to the individual electrode 112 (i.e., when the electrical potential difference between the individual electrode 112 and the ink in the individual ink flow passage 110 is smaller than the predetermined potential difference), the wetting angle of the ink at the surface of the insulating layer 115 is larger than the wetting angle of the ink at the surface of the insulating layer 116. Consequently, the meniscus of the ink in the individual ink flow passage 110 stops at an edge of the insulating layer 115 proximal to the insulating layer 116.

According to the second illustrative embodiment described above, since the common ink flow passage 109 and the individual ink flow passages 110 are disposed on the different planes, it is not necessary to arrange the wiring portions 113 so as to avoid the common ink flow passage 109. As a result more arrangement configurations of the wiring portions 113 may exist.

Furthermore, since all of the individual electrodes 112, the wiring portions 113, and the terminals 114 are disposed on the upper surface of the substrate 111, these components can be connected to each other on the upper surface of the substrate 111. Consequently, it is not necessary to form through-holes in the substrate 111 in order to connect these components. Thus, it is possible to simplify the structure of the ink transport head 101, and the manufacturing cost can be reduced. Furthermore, since the wiring portions 113 are covered with the insulating layer 116, the ink in the individual ink flow passages 110 can be prevented from being brought into contact with the wiring portions 113.

Furthermore, when an electrical potential that is smaller than the drive potential V1 is applied to the individual electrode 112 (i.e., when the electrical potential difference between the individual electrode 112 and the ink in the individual ink flow passage 110 is smaller than the predetermined potential difference), the wetting angle of the ink at the surface of the insulating layer 115 is larger than the wetting angle of the ink at the surface of the insulating layer 116. Consequently, when the ink is not discharged from the discharge port 110*a*, it is possible to stop the meniscus in the individual ink flow passage 110 at an edge of the insulating layer 115 proximal to the insulating layer 116.

Furthermore, since the wiring portions 113 extend through the regions between the individual ink flow passages 10 to the terminals 114 and since the portions of the insulating layer 116 covering the wiring portions 113 are covered with the partition walls 122, the wetting angle of portions of the insulating layer 116 exposed to the individual ink flow passage 110 does not change when a the drive potential V1 is applied to the individual electrodes 112.

When the drive potential V1 is applied to the individual electrode 112, the wetting angle of the ink at the surface of the insulating layer 115 is equal to the wetting angle of the ink at the surface of the insulating layer 116. Consequently, the ink can be smoothly transported in the individual ink flow passage 110.

Furthermore, since the common electrode 127 is disposed in the common ink flow passage 109, the ink in the common ink flow passage 109 and the ink in the individual ink flow passage 110 can be maintained at ground potential. Consequently, the electrical potential difference between the ink in the individual ink flow passage 110 and the individual electrode 112 does not easily change, thus enabling stable operation.

Modified illustrative embodiments in which various modifications are made in the second illustrative embodiment will be described below. The same reference numerals are used to designate components having a similar structure as the structure of the components in the second illustrative embodiment, and the descriptions thereof are omitted.

Figure 19:
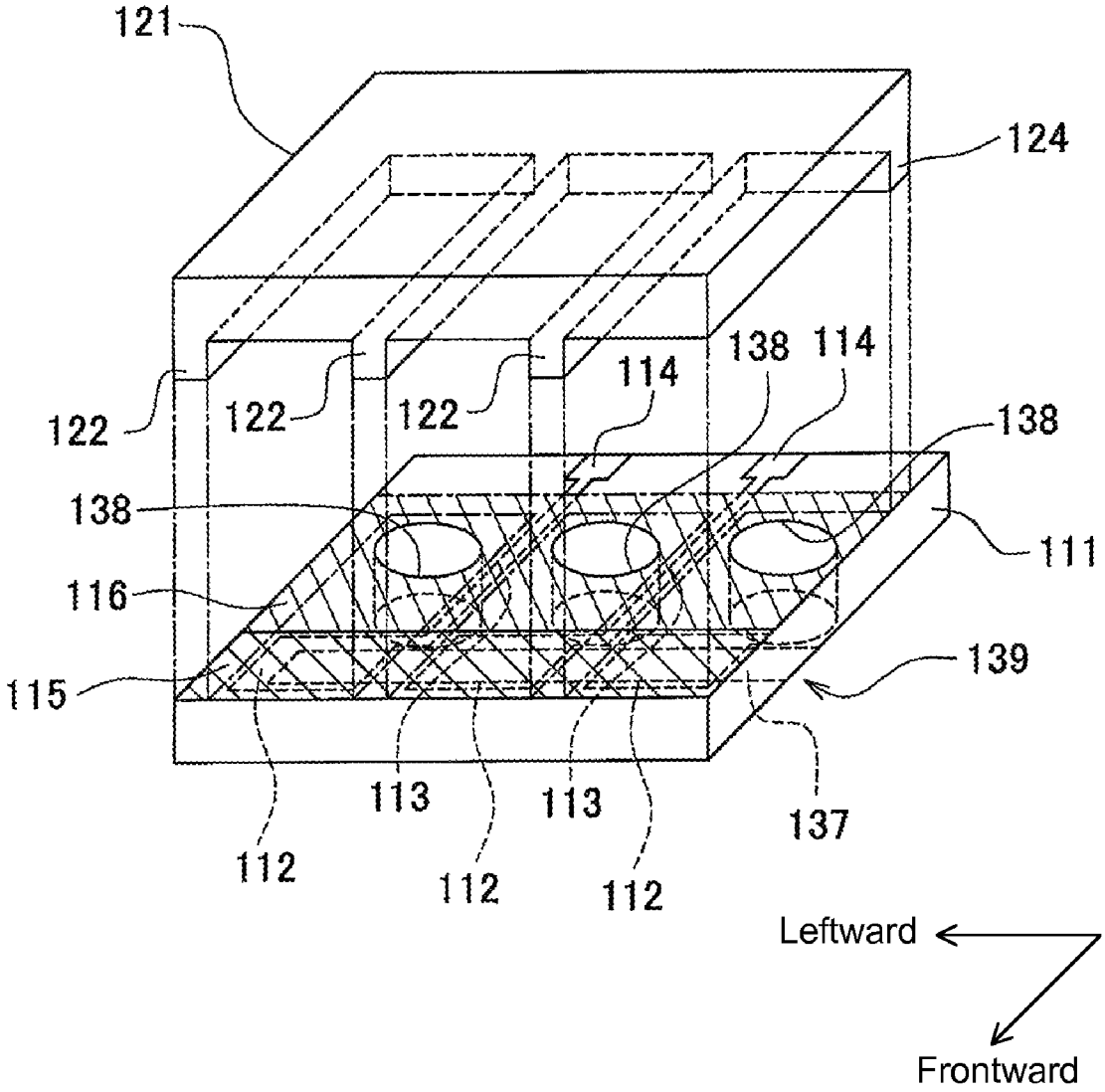
FIG. 19 is an exploded perspective view of a seventh modified illustrative embodiment, which corresponds to FIG. 15.

In the second illustrative embodiment, the common ink flow passage 109 is disposed above the individual ink flow passages 110. However, the common ink flow passage may be disposed below the individual ink flow passages 110, for example on a plane different from the plane on which the individual ink flow passages 110 are disposed. For example, according to a modified illustrative embodiment, as shown in FIG. 19, through-holes 138 each having a substantially circular planar shape are disposed proximal to the back end of the individual ink flow passages 110 in a plan view so as to pass through the substrate 111. A common electrode 137 is disposed on the lower surface of the substrate 111. A space delimited by the substrate 111 and a member (not shown) located below the substrate 111, in which the lower surface of the substrate 111 corresponds to a ceiling plane, serves as a common ink flow passage 139 (seventh modified illustrative embodiment). Even in this case, the ink in the common ink flow passage 139 flows into individual ink flow passages 110, and the ink is discharged from the discharge ports 110*a* in the same manner as in the second illustrative embodiment.

In the second illustrative embodiment, as in the first, second, third, and sixth modified illustrative embodiments of the first illustrative embodiment, the arrangements of the individual electrodes, the wiring portions, and the terminals can be changed, and a structure is also possible in which electrodes that are similar to the electrodes 51*a*, 51*b*, and 51*c* (refer to FIG. 11) according to the fourth modified illustrative embodiment of the first illustrative embodiment are provided.

In the first illustrative embodiment, the common electrode 17 is disposed in the common ink flow passage 9, and in the second illustrative embodiment, the common electrode 127 is disposed in the common ink flow passage 109. However, a structure may be used in which a common electrode is not disposed in a common liquid passage. Furthermore, a structure may be used in which a common ink flow passage is not provided and ink is supplied directly from an ink tank to individual ink flow passages.

In the first and second illustrative embodiments, the substrate 11 and the substrate 111 are each composed of an insulating material. However, the material is not limited thereto. A substrate having an insulating surface can be used. For example, a substrate composed of a conductive material on a surface of which a layer made of an insulating material is disposed may be used. The structure is not limited to the one in which ink is transported toward a recording sheet P. For example, a structure may be used in which ink is transported toward a transfer medium, such as a drum.

In the first and second illustrative embodiments, examples in which the present invention is applied to an ink transport head which transports ink have been described. Aspects of the present invention can apply to a liquid transport apparatus which transports a conductive liquid other than ink, such as a reagent, a bio-solution, a wiring material solution, an electronic material solution, a cooling medium, or a fuel.

What is claimed is:

1. A liquid transport apparatus comprising:

a substrate having an insulating surface;

a plurality of liquid transport channels which are disposed on the insulating surface of the substrate and in each of which a conductive liquid is transported;

a plurality of electrodes disposed on the insulating surface of the substrate in regions corresponding to respective ones of the liquid transport channels;

a plurality of wiring portions each having a terminal at an end thereof, and each wiring portion coupled to the surface of a corresponding one of the electrodes and extending along the insulating surface of the substrate;

a first insulating layer which is disposed so as to cover the plurality of electrodes on the insulating surface of the substrate and in which a wetting angle with respect to the conductive liquid changes according to an electrical potential difference between the conductive liquid and the electrodes;

a second insulating layer which is disposed so as to cover the plurality of wiring portions on the insulating surface of the substrate and which is disposed in contact with the first insulating layer; and a potential applying unit which applies an electric potential to each of the plurality of electrodes through each terminal provided on the wiring portions, wherein, when the electrical potential difference between the conductive liquid and the electrodes is less than a predetermined electrical potential difference, the wetting angle of the first insulating layer with respect to the conductive liquid is larger than the wetting angle of the second insulating layer with respect to the conductive liquid.

2. The liquid transport apparatus according to claim 1, wherein each of the plurality of wiring portions is disposed between two adjacent liquid transport channels.

3. The liquid transport apparatus according to claim 1, wherein each of the plurality of wiring portions is disposed in the respective ones of the liquid transport channels.

4. The liquid transport apparatus according to claim 1, wherein each of the plurality of wiring portions extends from corresponding ones of the electrodes toward an upstream side of a liquid transport direction.

5. The liquid transport apparatus according to claim 4, wherein the second insulating layer is disposed over the plurality of liquid transport channels so as to extend from an edge of the first insulating layer toward the plurality of terminals.

6. The liquid transport apparatus according to claim 1, wherein the potential applying unit selectively applies a predetermined first electrical potential or a predetermined second electrical potential to each of the electrodes, wherein when the first electrical potential is applied to an electrode, the wetting angle of the first insulating layer with respect to the conductive liquid is larger than a predetermined wetting angle at which the conductive liquid is caused to move from the second insulating layer to the first insulating layer in the liquid transport channel; and when the second electrical potential is applied to an electrode, the wetting angle of the first insulating layer with respect to the conductive liquid is decreased to at least the predetermined wetting angle.

7. The liquid transport apparatus according to claim 6, wherein when the second electrical potential is applied to the electrode, the wetting angle of the first insulating layer with respect to the conductive liquid is equal to or less than the wetting angle of the second insulating layer with respect to the conductive liquid.

8. The liquid transport apparatus according to claim 1, further comprising a common liquid passage which supplies the conductive liquid to each of the plurality of liquid transport channels.

9. The liquid transport apparatus according to claim 8, wherein the common liquid passage is disposed on a plane that is different from the insulating surface of the substrate on which the plurality of liquid transport channels is disposed.

10. The liquid transport apparatus according to claim 9, wherein a common electrode which is maintained at a predetermined electrical potential is disposed on a surface of the common liquid passage.

11. The liquid transport apparatus according to claim 8, wherein the common liquid passage is disposed on the insulating surface of the substrate on which the plurality of liquid transport channels is disposed;

the plurality of wiring portions extending from the plurality of electrodes to the plurality of terminals pass through the common liquid passage on the insulating surface of the substrate; and the plurality of wiring portions is covered with the second insulating layer in the common liquid passage.

12. The liquid transport apparatus according to claim 11, wherein a common electrode maintained at a predetermined electrical potential is disposed in a region constituting a surface of the common liquid passage; and the plurality of wiring portions covered with the second insulating layer and passing through the common liquid passage intersects with the common electrode.

13. The liquid transport apparatus according to claim 12, wherein, in sections where the plurality of wiring portions intersects with the common electrode, the length of the common electrode in a direction in which the wiring portions extend is less than the length of the common electrode in the direction in sections where the plurality of wiring portions does not intersect with the common electrode.

14. The liquid transport apparatus according to claim 12, wherein the common electrode completely covers the second insulating layer in the common liquid passage.

15. The liquid transport apparatus according to claim 1, further including a third insulating layer which is disposed on the insulating surface and closest to a portion of the first insulating layer different from a portion where the second insulating layer contacts the first insulating layer, wherein, when the electrical potential difference between the conductive liquid and the electrodes is less than a predetermined electrical potential difference, the wetting angle of the first insulating layer with respect to the conductive liquid is larger than the wetting angle of the third insulating layer with respect to the conductive liquid.

16. The liquid transport apparatus according to claim 15, wherein the third insulating layer contacts a first side of the first insulating layer and the second insulating layer contacts a second side of the first insulating layer opposite the first side.

17. The liquid transport apparatus according to claim 15, further including at least one additional electrode disposed on the insulating surface of the substrate and corresponding to respective ones of the liquid transport channels.

18. The liquid transport apparatus according to claim 17, wherein the third insulating layer contacts a first side of the first insulating layer and the second insulating layer contacts a second side of the first insulating layer opposite the first side.

* * * * *